US007791572B2

(12) United States Patent
Hwang

(10) Patent No.: US 7,791,572 B2
(45) Date of Patent: Sep. 7, 2010

(54) FLAT DISPLAY PANEL, PICTURE QUALITY CONTROLLING APPARATUS AND METHOD THEREOF

(75) Inventor: Jong Hee Hwang, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 1071 days.

(21) Appl. No.: 11/477,567

(22) Filed: Jun. 30, 2006

(65) Prior Publication Data

US 2007/0126758 A1 Jun. 7, 2007

(30) Foreign Application Priority Data

Dec. 7, 2005 (KR) ..... 10-2005-0118966

(51) Int. Cl.
*G09G 3/36* (2006.01)

(52) U.S. Cl. ..... 345/87; 345/88; 345/89; 345/690

(58) Field of Classification Search ..... 345/58, 345/63, 72, 77–78, 83, 87–89, 98, 690; 349/192; 382/141, 149
See application file for complete search history.

(56) References Cited

U.S. PATENT DOCUMENTS

| | | | | |
|---|---|---|---|---|
| 6,558,006 | B2 * | 5/2003 | Ioka | 353/94 |
| 6,603,452 | B1 * | 8/2003 | Serita | 345/88 |
| 6,704,008 | B2 * | 3/2004 | Naito et al. | 345/207 |
| 6,847,342 | B2 * | 1/2005 | Tsuji | 345/82 |
| 2002/0067326 | A1 * | 6/2002 | Aoki | 345/89 |
| 2003/0222839 | A1 * | 12/2003 | Lee | 345/88 |
| 2005/0116917 | A1 * | 6/2005 | Aoki | 345/99 |
| 2005/0190198 | A1 * | 9/2005 | Koyama | 345/593 |
| 2006/0092329 | A1 * | 5/2006 | Noji | 348/607 |

FOREIGN PATENT DOCUMENTS

| | | |
|---|---|---|
| JP | 5-197357 | 8/1993 |
| JP | 8-179727 | 7/1996 |
| JP | 2001-343953 | 12/2001 |
| JP | 2003-66924 | 3/2003 |
| JP | 2004-198875 | 7/2004 |
| JP | 2004-279482 | 10/2004 |
| JP | 2005-43725 | 2/2005 |
| JP | 2005-242359 | 9/2005 |
| JP | 2005-249821 | 9/2005 |

* cited by examiner

*Primary Examiner*—Amare Mengistu
*Assistant Examiner*—Hong Zhou
(74) *Attorney, Agent, or Firm*—Morgan, Lewis & Bockius LLP

(57) ABSTRACT

A method of controlling a picture quality of a flat panel display device includes storing a first compensation data used to compensate a panel defect area of a display panel, wherein the first compensation data is judged by a first inspection process, storing a second compensation data used to compensate a boundary between the panel defect area and a non-defect area of the display panel, wherein the second compensation data is judged by a second inspection process; a first compensation step to modulate data using the first compensation data stored in a memory, wherein first modulated data are supplied to the panel defect area; a second compensation step to modulate data using the second compensation data stored in the memory, wherein second modulated data are supplied to the boundary of the panel defect area and the non-defect area; and displaying the second modulated data on the display panel.

46 Claims, 32 Drawing Sheets

(a)

(b)

(a)

(b)

(a)

(b)

FLAT DISPLAY PANEL, PICTURE QUALITY CONTROLLING APPARATUS AND METHOD THEREOF

This application claims the benefit of the Korean Patent Application No. P2005-0118966 filed on Dec. 7, 2005 which is hereby incorporated by reference.

BACKGROUND OF THE INVENTION

1. Field of the Invention

The present invention relates to a flat panel display device, and more particularly to a flat panel display device that improves picture quality by compensating a panel defect with electrical data.

2. Discussion of the Related Art

Display devices are very important in the information society as a visual information communicating media. Lately, there have been problems in conventional display devices, such as cathode ray tubes (CRT). For example, a CRT display device has a significantly heavy weight and a bulky volume. Due to these problems, there have been developments in various flat panel display devices that can overcome the limitations of such CRT display devices. Such flat panel displays include a liquid crystal display (LCD), a field emission display (FED), a plasma display panel (PDP) and an organic light emitting diode (OLED). Most of these flat panel display devices are put to practical use having significant market share in the display device market.

Flat panel display devices include a display panel for displaying a picture. In these display panels, a mura defect typically can be found as a panel defect during the test process of such display panels. Here, a mura is to be construed as a display spot accompanying brightness differences and chromaticity differences on the display screen. The panel defects are mostly generated in a fabricating process, and typically have a fixed form including a dot, line, belt, circle, and polygon, or an undetermined form in accordance with the cause of their generation. Examples of panel defects having such various forms are shown in FIG. 1 to FIG. 3.

FIG. 1 represents a panel defect having an undetermined form. FIG. 2 represents a panel defect of a vertical belt shape. FIG. 3 represents a panel defect of a fixed form. The vertical belt shaped panel defect in FIG. 2 is generated for reasons including overlapping exposure and differences in the lens number. The dot shaped panel defect in FIG. 3 is mainly generated by impurities. As shown in FIG. 3, such panel defect appears to be darker or brighter than an ambient non-defect area. Further, color difference is made when compared with another non-defect area.

Panel defects can lead to defects of the end products, which ultimately results in low production yield. Further, even if the product with panel defects is successfully shipped as a product, the deterioration of the picture quality due to the panel defect can lower the reliability of the product. Accordingly, various methods have been proposed in order to minimize panel defects. The main approach to minimize a panel defect, according to the related art, was to improve the process technology. However, even with an improved process technology, the panel defect can only be relaxed. The panel defect cannot be completely removed according to an improved process technology, according to the related art.

SUMMARY OF THE INVENTION

Accordingly, the present invention is directed to a flat display panel, picture quality controlling apparatus and method thereof that substantially obviates one or more of the problems due to limitations and disadvantages of the related art.

An object of the present invention is to provide a flat panel display device that improves picture quality by compensating a panel defect with electrical data.

Another object of the present invention is to provide a method for controlling the picture quality of the flat panel display device.

Additional features and advantages of the invention will be set forth in the description which follows, and in part will be apparent from the description, or may be learnt by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the flat display panel, picture quality controlling apparatus and method thereof includes, a method of controlling a picture quality of a flat panel display device includes storing a first compensation data used to compensate a panel defect area of a display panel, wherein the first compensation data is judged by a first inspection process, storing a second compensation data used to compensate a boundary between the panel defect area and a non-defect area of the display panel, wherein the second compensation data is judged by a second inspection process; a first compensation step to modulate data using the first compensation data stored in a memory, wherein first modulated data are supplied to the panel defect area; a second compensation step to modulate data using the second compensation data stored in the memory, wherein second modulated data are supplied to the boundary of the panel defect area and the non-defect area; and displaying the second modulated data on the display panel.

In another aspect, an apparatus for controlling a picture quality of a flat panel display device includes a memory to store a first and a second compensation data, wherein the first compensation data is used to compensate a panel defect area of a display panel and is judged by a first inspection process, the second compensation data is used to compensate a boundary between the panel defect area and a non-defect area of the display panel and is judged by a second inspection process; a first compensation part to modulate data using the first compensation data stored in the memory, wherein first modulated data are supplied to the panel defect area; and a second compensation part to modulate the first modulated data using the second compensation data stored in the memory, wherein second modulated data are supplied to the panel defect area and the non-defect area, and to supply un-modulated data to the non-defect area.

In yet another aspect, a flat panel display device includes a display panel to display an image; a memory that stores a first compensation data to compensate a panel defect area of a display panel, wherein the first compensation data is judged by a first inspection process, a second compensation data to compensate a boundary between the panel defect area and a non-defect area of the display panel, wherein the second compensation data is judged by a second inspection process; a first compensation part to modulate data using the first compensation data stored in the memory, wherein the modulated data are supplied to the panel defect area; a second compensation part to modulate the first modulated data using the second compensation data stored in the memory, wherein second modulated data are supplied to the panel defect area and the non-defect area, and to supply un-modulated data to the non-defect area; and a driver to display the data modulated by the second compensation part on the display panel It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments of the present invention, examples of which are illustrated in the accompanying drawings.

As shown in FIGS. 4 to 23, exemplary embodiments of the present invention will be explained as follows. In the following exemplary embodiments, compensating a panel defect having the vertical strip shape will be described.

Figure 1:
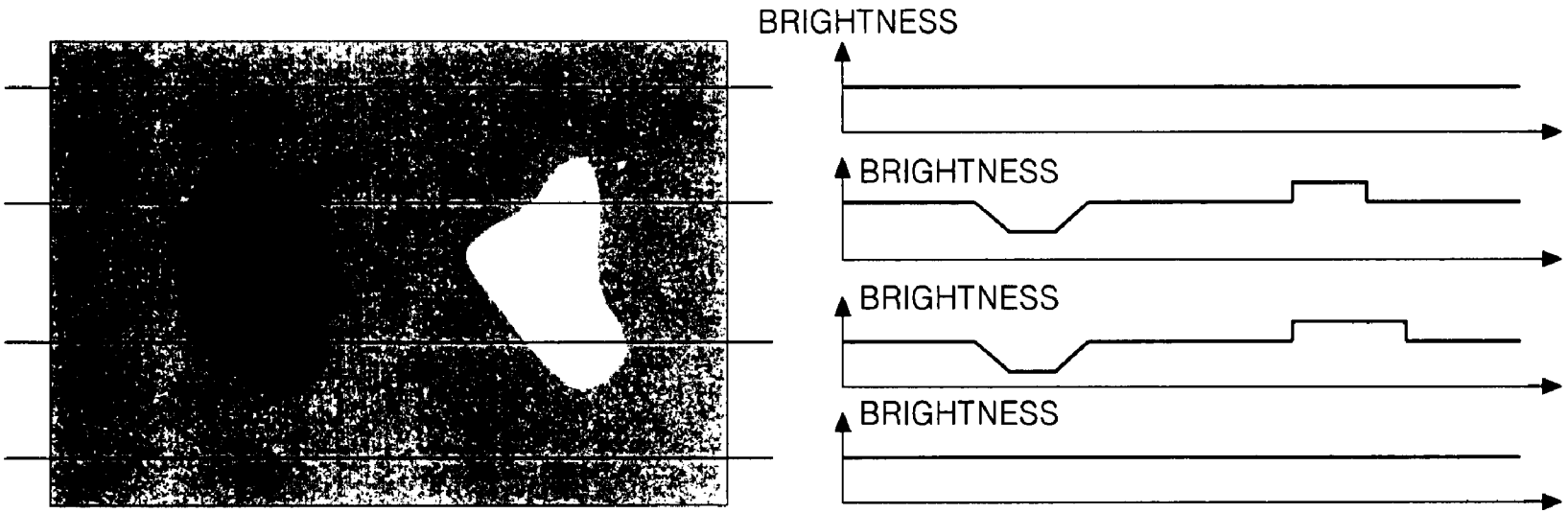
FIG. 1 RELATED ART
FIG. 1 is a diagram showing one example of a related art panel defect having an undetermined form.
Figure 2:
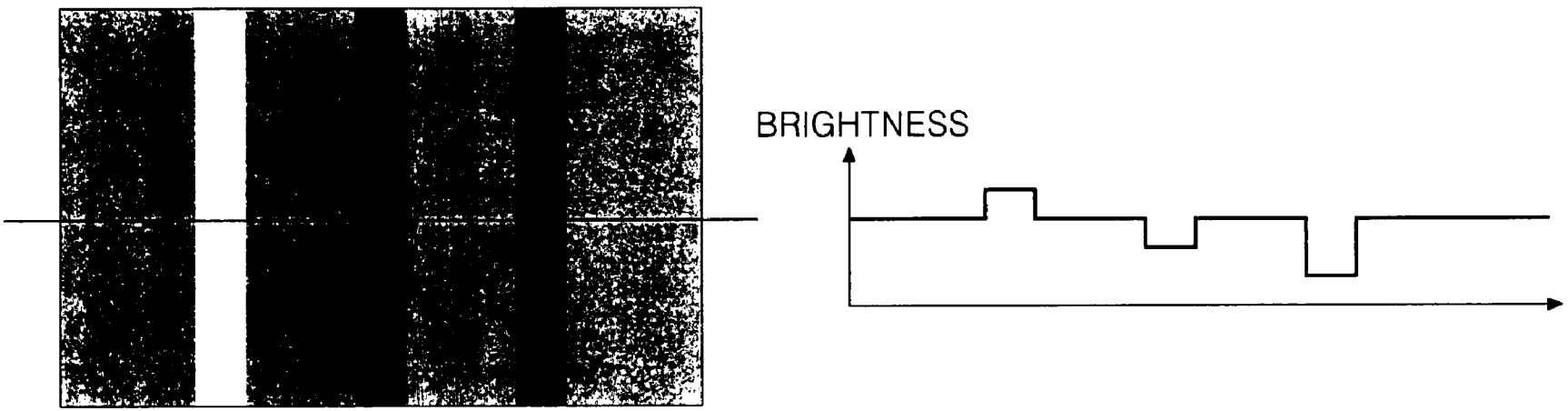
FIG. 2 RELATED ART
FIG. 2 is a diagram showing one example of a related art panel defect having a vertical belt shape.
Figure 3:
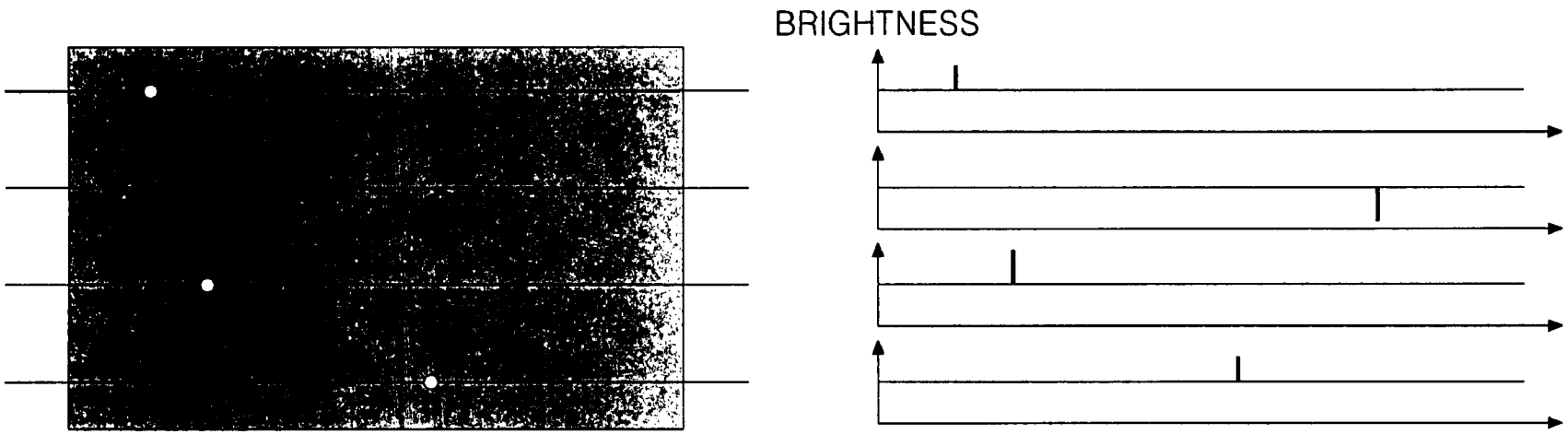
FIG. 3 RELATED ART
FIG. 3 is a diagram showing one example of a related art panel defect having a dot shape.
Figure 4:
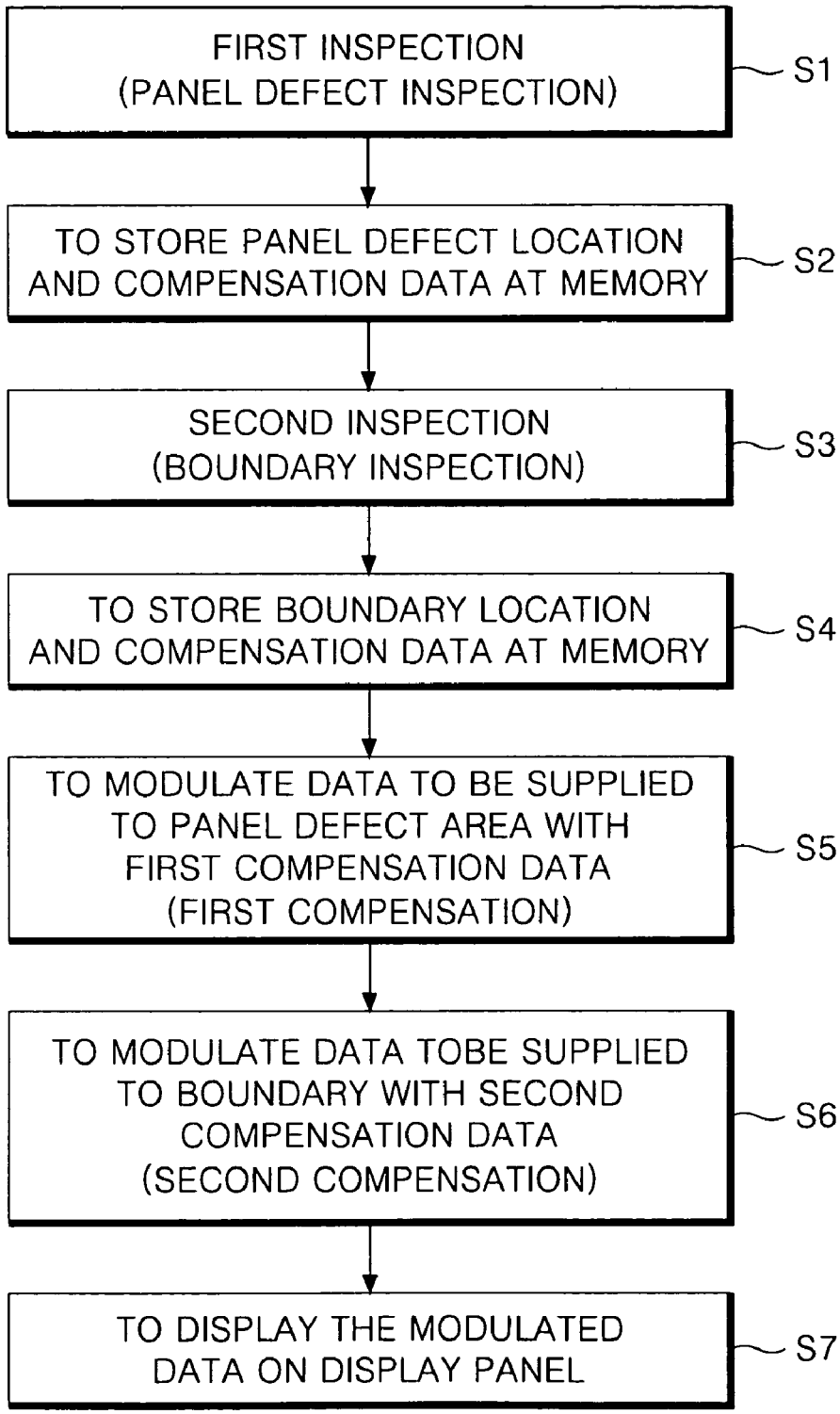
FIG. 4 is a flow chart representing a step by step fabricating method of a flat panel display device according to an exemplary embodiment of the present invention.

The exemplary method of controlling a picture quality of a flat panel display device (hereinafter "exemplary method") is explained in reference to FIG. 4. The step S1 of the exemplary method inspects panel defects by applying a test data of each gray scale level to display test pictures on the display panel of the flat panel display device. A display stain appearing on the picture is inspected by an electrical inspection and/or macrography in the inspection process S1 of the flat panel display. If the panel defect is found on the flat panel display in the inspection process S1, step S2 analyzes a degree of panel defect and a location where the panel defect is formed. In addition, the panel defect location data and the panel defect compensation data for each gray scale area are stored in a non-volatile memory at step S2. The panel defect compensation data for each gray scale level area and the panel defect location data are defined as a first compensation data and a first location data. The first location data and the first compensation data for each gray scale area are differentiated in accordance with a location and a degree of the panel defect.

The exemplary method further includes step S3 to analyze a degree of boundary noise and a location where boundary noise is formed. At step S4, the boundary noise location data and the boundary noise compensation data for each gray scale area are stored in the non-volatile memory. At this point, the boundary noise compensation data for each gray scale level area and the boundary noise location data are differentiated in accordance with the degree and location of the boundary noise, in the same manner as the first location and the first compensation data. The boundary noise compensation data for each gray scale level area and the boundary noise location data are defined as a second compensation data and a second location data. Examples of non-volatile memory include an Electrically Erasable Programmable Read Only Memory (EEPROM) or Extended Display Identification Data ROM (EDID ROM) that is adapted to renew or erase the data. For the discussion of the exemplary embodiments, the EEPROM will be used.

The exemplary method compensates the brightness of the panel defect area by using the first compensation data. A data is modulated using the first compensation data and the first location data stored in the non-volatile memory in step S2. The modulated data is applied to the display panel of the flat panel display device for each gray scale level, thereby inspecting whether or not the noise is generated at the boundary of the panel defect area and the non-defect area. The presence of the noise in the picture displayed on the panel is inspected by the electrical inspection and/or macrography at step S3. Herein, the boundary noise means an abnormal brightness phenomenon that appears in adjacent pixels along the boundary of the panel defect area and the non-defect area. Examples of noise include the phenomenon where brightness of pixels adjacent along the boundary of the panel defect area and non-defect area increases and/or decreases abnormally even after compensating the brightness of the panel defect area with the first compensation data. The exemplary method further includes step S5 to compensate the brightness of the panel defect area with the first compensation data by modulating the data that is to be supplied to the panel defect area. The modulation of the data which is to be supplied to the panel defect area by the first compensation data is called as the first exemplary compensation method, and will be described in detail as follows.

Figure 5:
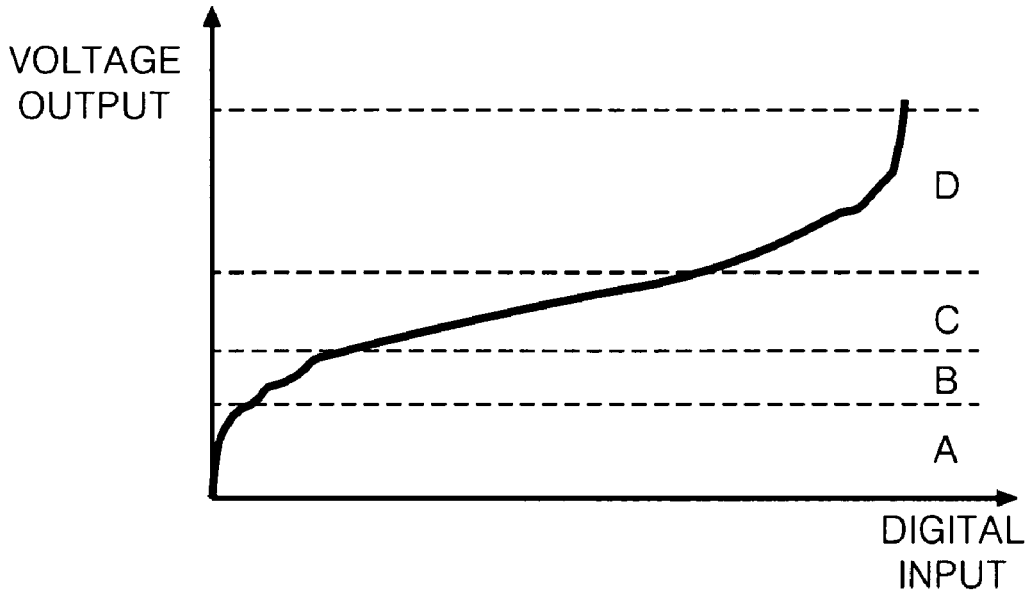
FIG. 5 is an exemplary diagram showing a gamma correction curve illustrating that the panel defect compensation data are divided for each gray scale level section to be set.

The panel defect compensation data stored in the EEPROM has the color difference non-uniformity degree or brightness different non-uniformity degree in accordance with the location of the panel defect. Accordingly, the panel defect compensation data should be optimized for each location. Further, the panel defect compensation data should be optimized for each gray scale level in consideration of gamma characteristics of FIG. 5. Specifically, the panel defect compensation data for each gray scale level can be set. For example, as shown in FIG. 5, values for each of R, G, B, can be individually set for each gray scale level section A, B, C and D. Thus, the panel defect compensation data can optimized as follows: '+1' in a 'location 1', '−1' in a 'location 2' and '0' in a 'location 3'. Similarly, the panel defect compensation data for each gray scale level section can be optimized as follows: '0' in a 'gray scale level section A', '0' in a 'gray scale level section B', '1' in a 'gray scale level section C' and '1' in a 'gray scale level section D'. The panel defect compensation data can be made different for each gray scale level in the same location, and made different for each location in the same gray scale level. The panel defect compensation data for each of R, G, B data can be set to a same value in the brightness correction. Further, the panel defect compensation data for each R, G, B data can be set to a different value when correcting the color difference. For example, if color 'red' appears in a specific panel defect location substantially more than in a non-defect location, an R compensation value becomes lower than the G, B compensation values. The panel defect compensation data for each gray scale level area and the panel defect location data are named as a first compensation data and a first location data.

Figure 6A:
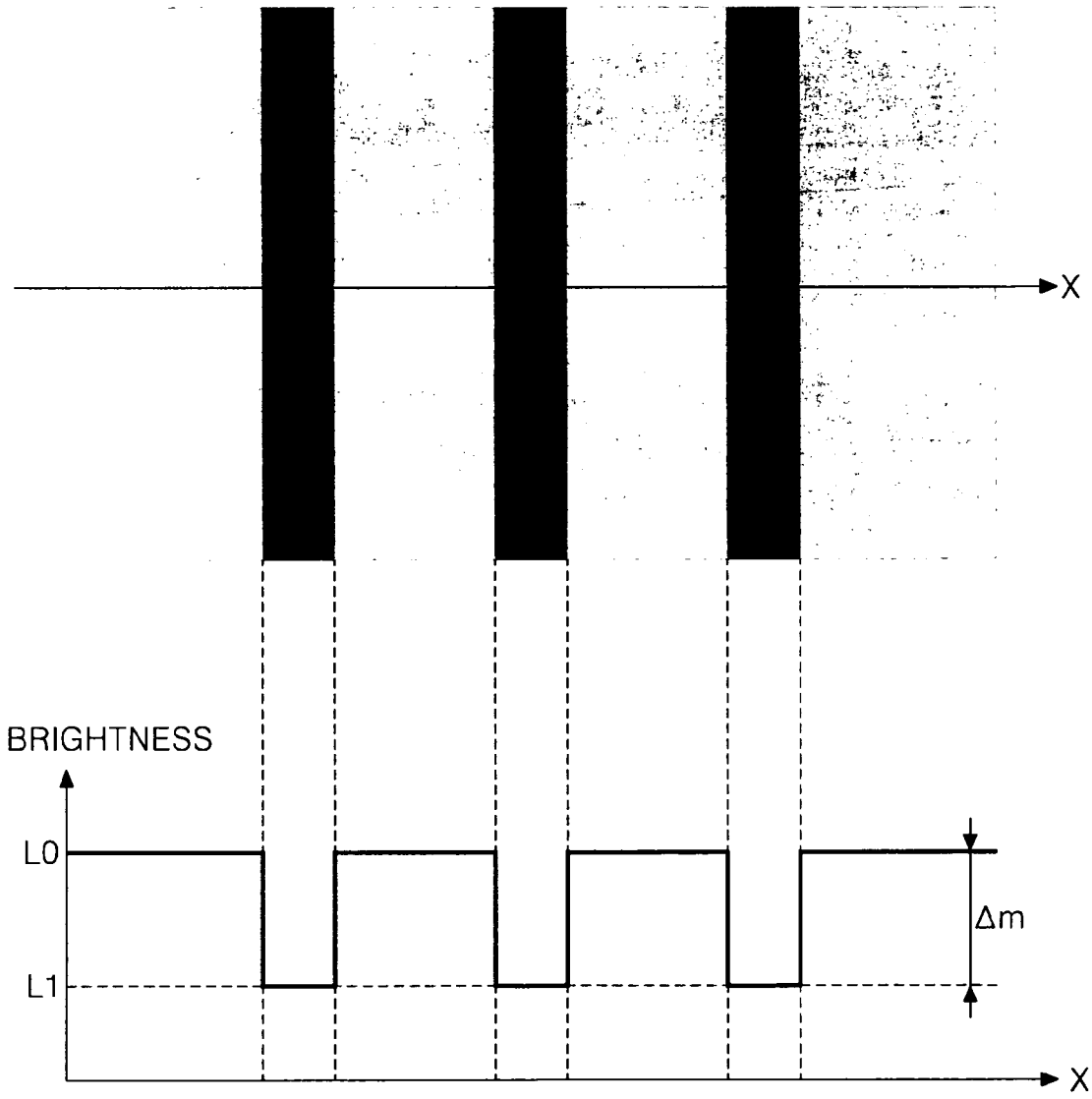
FIGS. 6A to 6D are views representing noise appearing at a boundary of a panel defect area and a non-defect area.
Figure 6B:
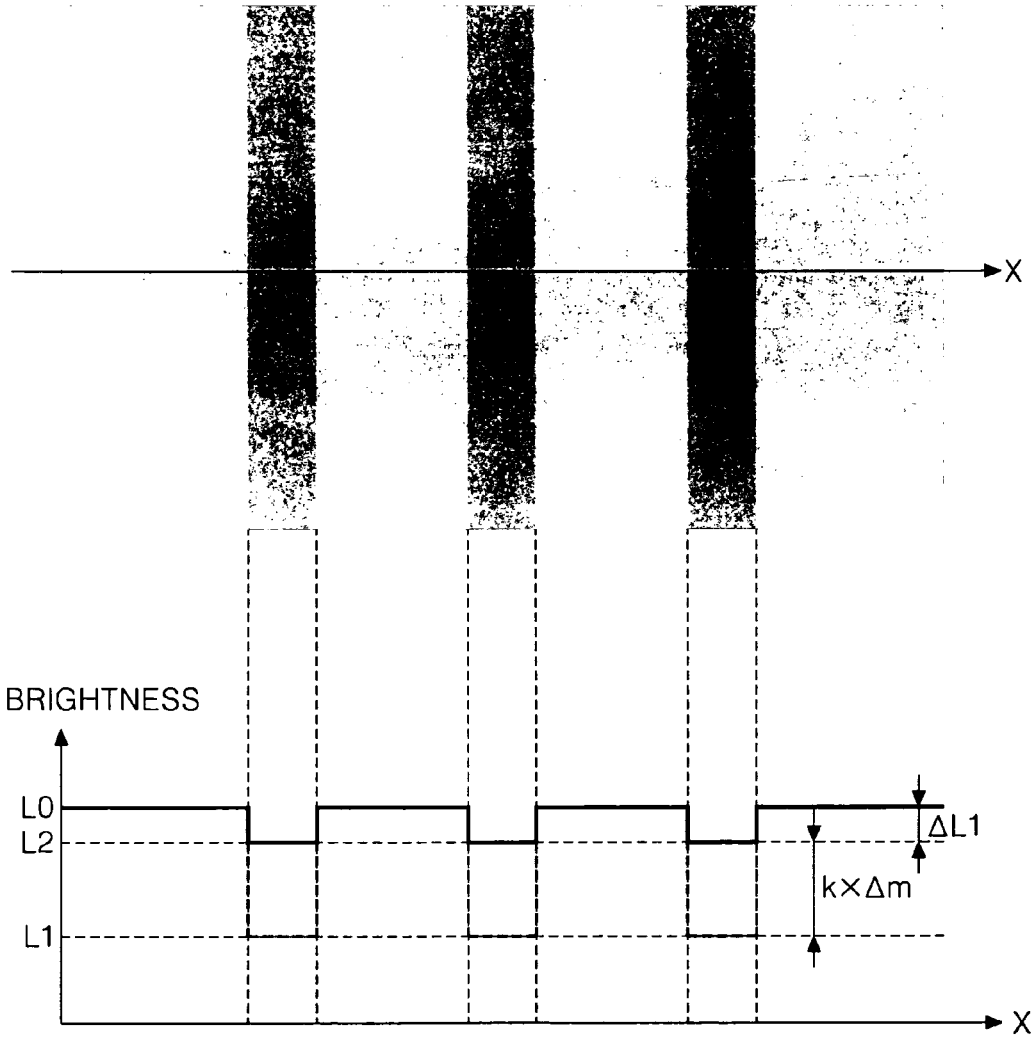
Figure 6C:
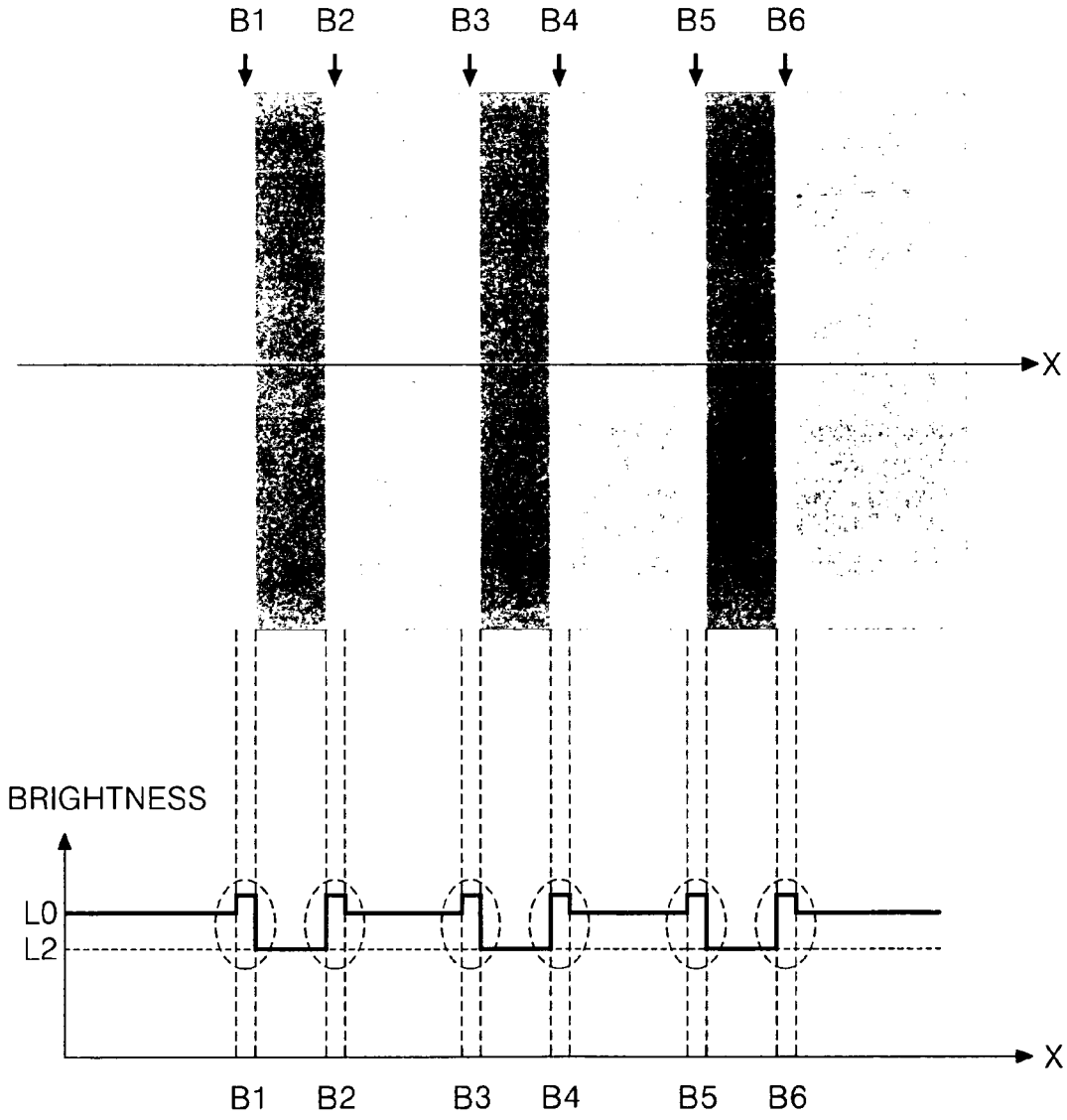

Examples of boundary noise are shown in FIGS. 6A to 6D. As shown in FIG. 6A, if a minimum brightness interval which can be displayed by the flat panel display device is 'Δm', the brightness of the non-defect area is L0, the brightness of the panel defect area is L1, and maximum difference in brightness is ΔL0, the brightness of the panel defect area is compensated as much as k×Δm (k is an arbitrary integer). As shown in FIG. 6B, the brightness is compensated by the first compensation data, thereby reducing the brightness of the panel defect area and the non-defect area by ΔL1 which is lower than ΔL0. However, as shown in FIG. 6C, even though the first compensation data are set close to a perfect compensation value (i.e., the brightness of the panel defect area becomes closest possible to or is identical to the brightness of the non-defect area), occasionally a phenomenon that the abnormal increase and abnormal decrease in the brightness can be generated at the boundary of the panel defect area and the non-defect area (FIG. 6C, boundaries B1 to B6).

Figure 6D:
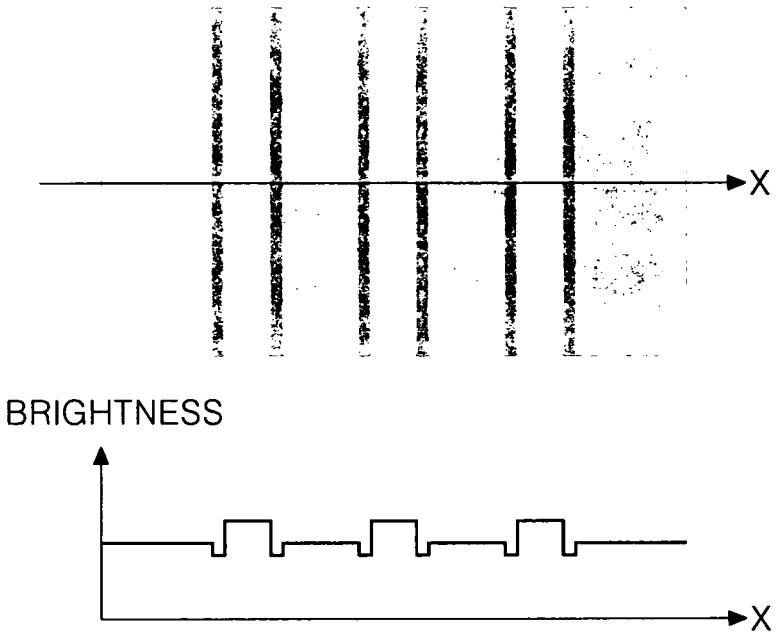
Figure 6D:
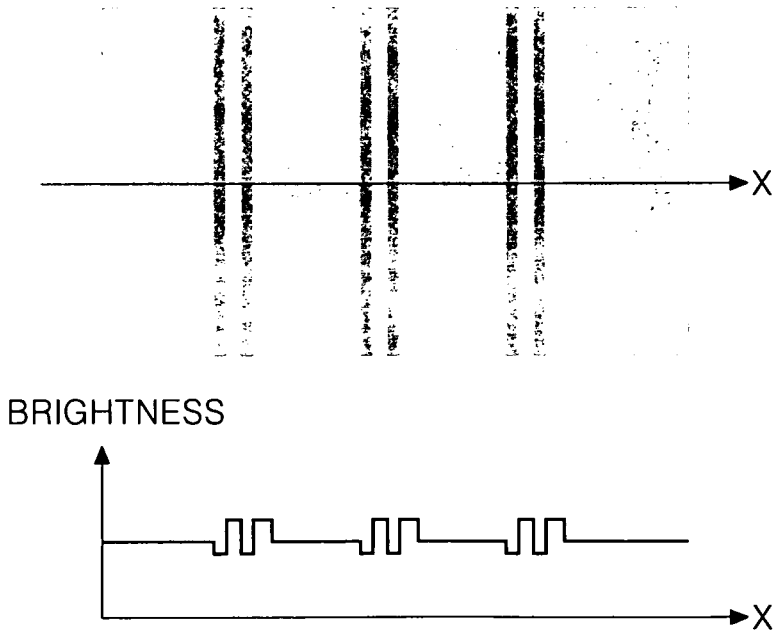

Accordingly, the exemplary method includes compensating the brightness of the panel defect area using the first compensation data first, where the first compensation data is judged by a first inspection process for the panel defect area. Then, the method inspects whether or not the noise is generated at the boundary of the picture where the brightness of the panel defect area is compensated with the first compensation data. When the boundary noise appears in various widths/shapes as shown in FIGS. 6C and 6D, the boundary noise may be included in any one of the panel defect area and the non-defect area. As such, the Δm may have a different value for each flat panel display device because of the various picture process techniques applied or a capacity of data process that a drive circuit included in the instant flat panel display device can perform. For example, the Δm in the flat panel display device having the drive circuit of 6 bit process capacity is different from the Δm in the flat panel display device having the drive circuit of 8 bit process capacity. In addition, due to the types of picture process techniques applied, the Δm value can be different for the flat panel display devices even when the drive circuits of the same bit process capacity is included in the devices.

Returning to FIG. 4, the exemplary method further includes step S6 to compensate the boundary noise by second compensation data. The data included in the panel defect area are modulated by the foregoing step S5 and the modulated data are to be supplied to the boundary of the panel defect area and the non-defect area. When the boundary noise is formed over both the panel defect area and the non-defect area, the second compensation data includes the data modulated with the first compensation data that are to be supplied to the panel defect area and the un-modulated data that are to be supplied to the non-defect area. The modulation of the data to be supplied to the panel defect area and the non-defect area by the second compensation data is called the second exemplary compensation method. The second exemplary compensation method can be any one of the compensation methods explained in the first to sixth exemplary embodiments of the first exemplary compensation method. Accordingly, a detailed description for the second exemplary compensation method will be omitted. Instead, the compensation pattern generated in accordance with the noise pattern at the boundary will be explained by specific examples.

The first exemplary compensation method according to the first exemplary embodiment of the present invention modulates the data which is to be supplied to the panel defect area by way of increasing or decreasing the data. The first compensation data includes one pixel data, specifically, compensation data R to compensate color red, compensation data G to compensate color green, compensation data B to compensate color blue. The first compensation data are set as having the same value for each R, G, B compensation data in the brightness correction. On the other hand, the first compensation data are set to a different value for each R, G, B compensation in the color difference correction. The first compensation data are set by the unit of pixel in the brightness correction, and/or set by the unit of sub-pixel in the color difference correction.

Figure 7A:
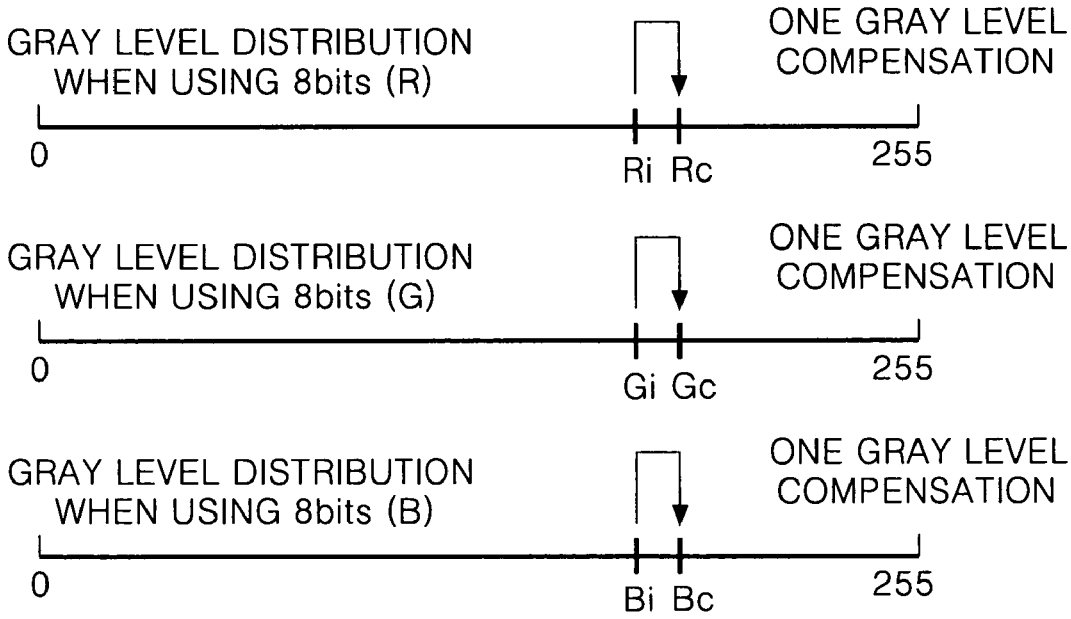
FIGS. 7A and 7B are exemplary diagrams showing a panel defect compensation result of the compensation circuit shown in FIG. 15 based on a picture quality controlling method of a flat panel display device according to a first exemplary embodiment of the present invention.
Figure 7B:
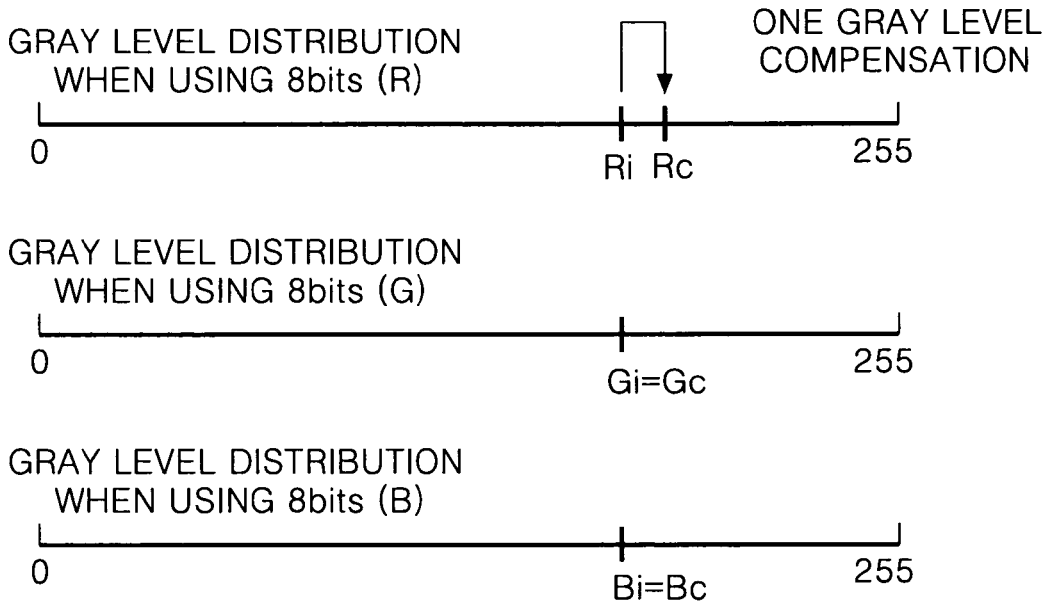

As shown in FIG. 7A, one exemplary example of the panel defect compensation by the first exemplary compensation method defines the R compensation data, G compensation data, and B compensation data to be '1' to increase the gray scale level of all three color data which is to be displayed in the panel defect location. In this way, the gray scale level of the non-defect location is lower by one gray scale level '1' compared to the panel defect area, thereby enabling to compensate the brightness of the panel defect location. Further, as shown in FIG. 7B, another exemplary example of the panel defect compensation by the first exemplary compensation method defines the R compensation data to be '1' and the G and B compensation data to be '0', thereby enabling to compensate the color difference of the color data which is to be displayed in the panel defect location where the purity of red color is lower than in the non-defect location. A more detailed discussion for the first exemplary compensation method will be provided with reference to the first exemplary compensation circuit of the first exemplary embodiment later.

Figure 8A:
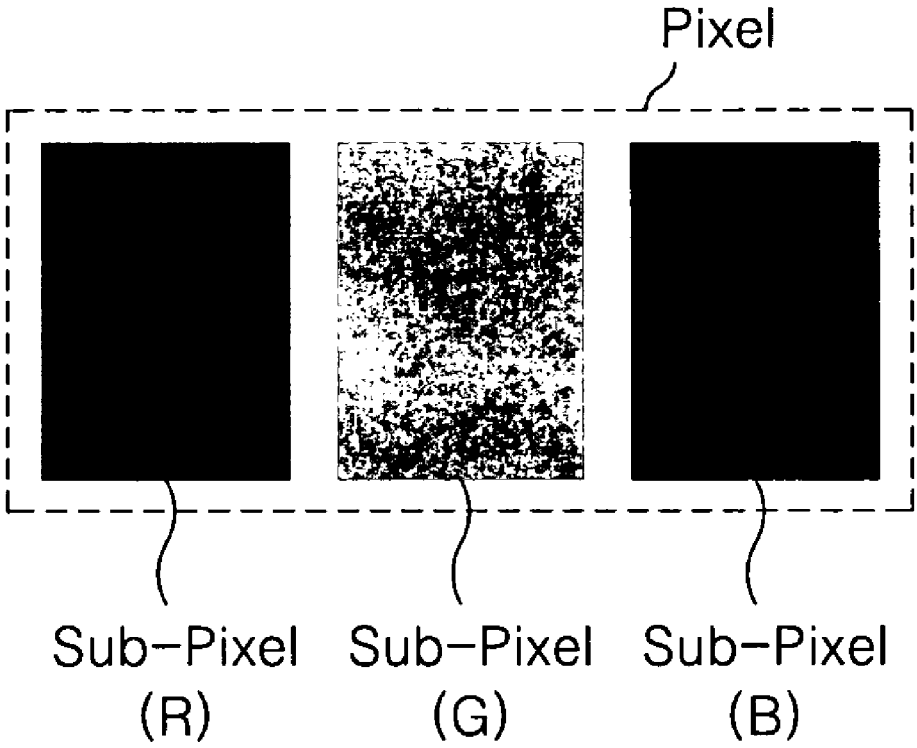
FIGS. 8A and 8B are exemplary diagrams showing two examples of pixel arrangement.
Figure 8B:
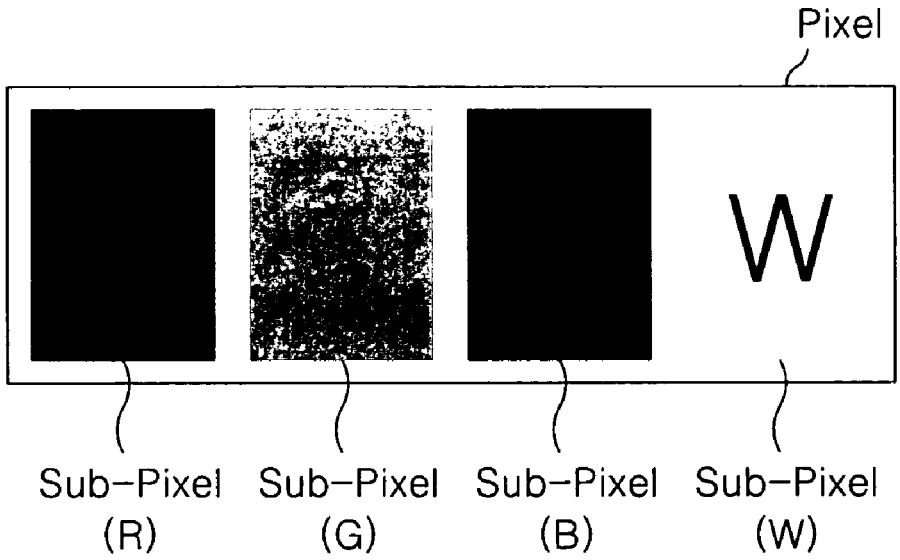

Next, a second exemplary embodiment of the present invention will be described. As shown in FIG. 8A, one pixel of the flat panel display device may include three sub-pixels of red R, green G, blue B. Or, as shown in FIG. 8B, one pixel of the flat panel display device may include four sub-pixels of red R, green G, blue B and white W. The first exemplary compensation method according to the second exemplary embodiment of the present invention includes that the first compensation data has W compensation data to compensate color white W data other than R, B, G compensation data. As discussed earlier, the data which is to be supplied to the panel defect area are now modulated by the first compensation data that includes R, G, B, and W compensation data. In this way, if the white data are compensated, the brightness compensation can be made more easily in the panel defect location. A more detailed discussion for the first exemplary compensation method according to the second exemplary embodiment of the present invention will be provided referring to the first exemplary compensation circuit later.

The first exemplary compensation method according to a third exemplary embodiment of the present invention will be explained next. The first exemplary compensation method of the third exemplary embodiment converts the input data red Ri, green Gi, blue Bi of m bits which are to be displayed in the panel defect area into brightness Yi and color difference Ui/Vi data of n bits (n is an integer greater than m) using the following Mathematical Formulas 1 to 3.

$$Yi=0.299Ri+0.587Gi+0.114Bi \quad \text{[Mathematical Formula 1]}$$

$$Ui=-0.147Ri-0.289Gi+0.436Bi=0.492(Bi-Yi) \quad \text{[Mathematical Formula 2]}$$

$$Vi=0.615Ri-0.515Gi-0.100Bi=0.877(Ri-Yi) \quad \text{[Mathematical Formula 3]}$$

In addition, the modulated red Rc data of m bits, the modulated green Gc data of m bits and the modulated blue Bc data are generated by the following Mathematical Formulas 4 to 6, with the modulated brightness Yc data of n bits and the un-modulated color difference Ui/Vi data.

$$Rc=Yc+1.140Vi \quad \text{[Mathematical Formula 4]}$$

$$Gc=Yc-0.395Ui-0.581Vi \quad \text{[Mathematical Formula 5]}$$

$$Bc=Yc+2.032Ui \quad \text{[Mathematical Formula 6]}$$

A more detailed discussion for the first exemplary compensation method according to the third exemplary embodiment of the present invention will be provided in reference to the first exemplary compensation circuit of the third embodiment later.

Figure 9:
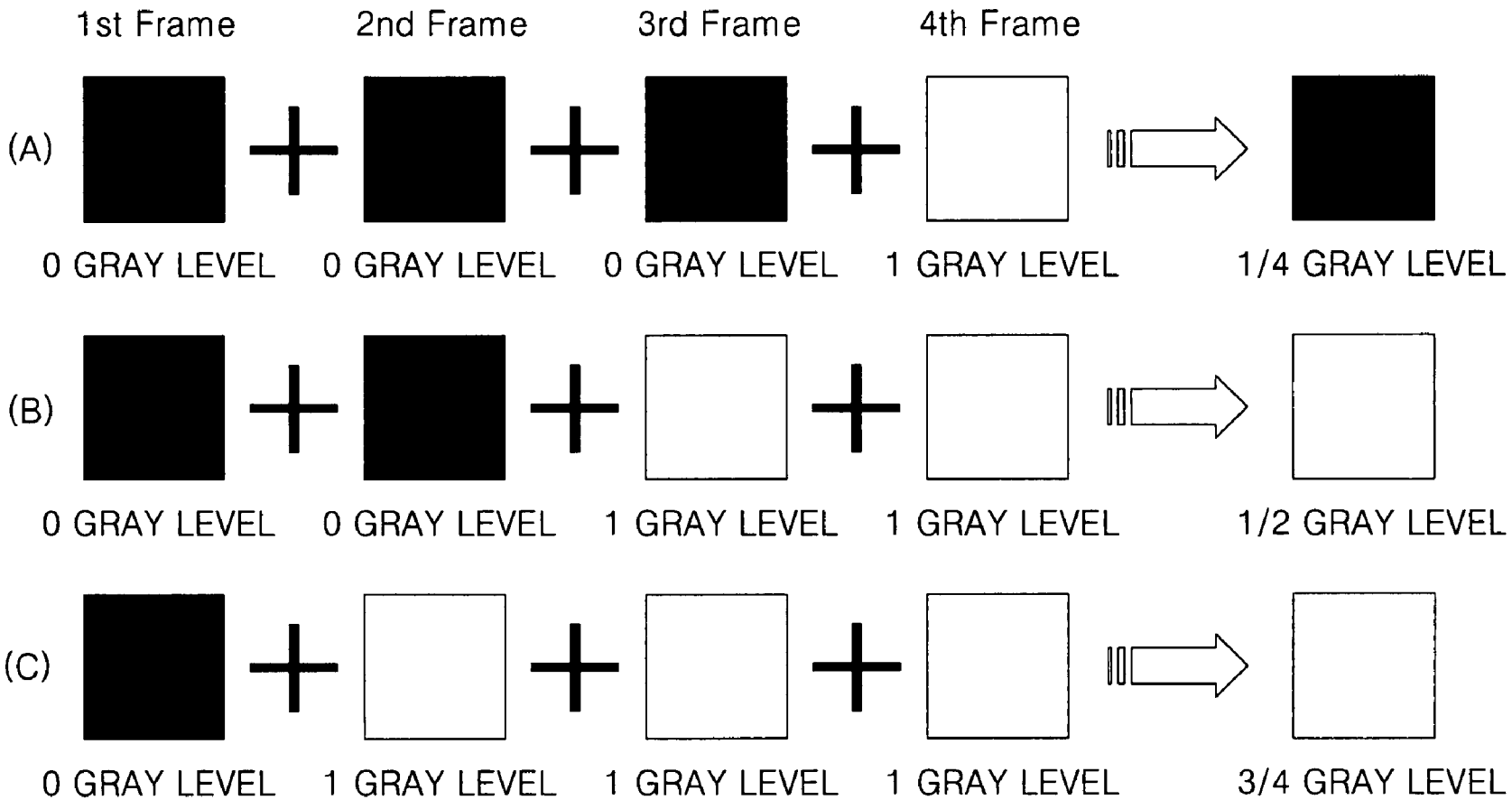
FIG. 9 is an exemplary diagram showing one example of frame rate control.

The first exemplary compensation method according to fourth to sixth exemplary embodiments of the present invention adjusts the data which are to be displayed in the panel defect location by using frame rate control (FRC) and dithering, which are known as a method for adjusting picture quality. The frame rate control (FRC) and dithering will be explained in reference to FIGS. 9 to 11. As shown in FIG. 9A, in the frame rate control, let us first assume that there is one pixel where a '0' gray scale level and a '1' gray scale level are sequentially displayed for four frames. If the pixel displays the '0' gray scale level for three frames and the '1' gray scale level for the remaining one frame, an observer feels a '¼' gray scale level for the four frames due to an integral effect of his retina. On the other hand, if the same pixel displays the '0' gray scale level for two frames and the '1' gray scale level for the other two frames, the observer feels a '½' gray scale level for the four frames due to an integral effect of his retina, as shown in FIG. 9B. If the same pixel displays the '0' gray scale level for one frame and the '1' gray scale level for the three other frames, the observer feels a '¾' gray scale level for the four frames due to an integral effect of his retina, as shown in FIG. 9C. The first exemplary compensation method according to the fourth exemplary embodiment of the present invention modulates the data which are to be displayed in the panel defect location by the frame rate control. A detailed discussion for the data modulation using the frame rate control will be provided with reference to the first exemplary compensation circuit of the fourth exemplary embodiment later.

Figure 10:
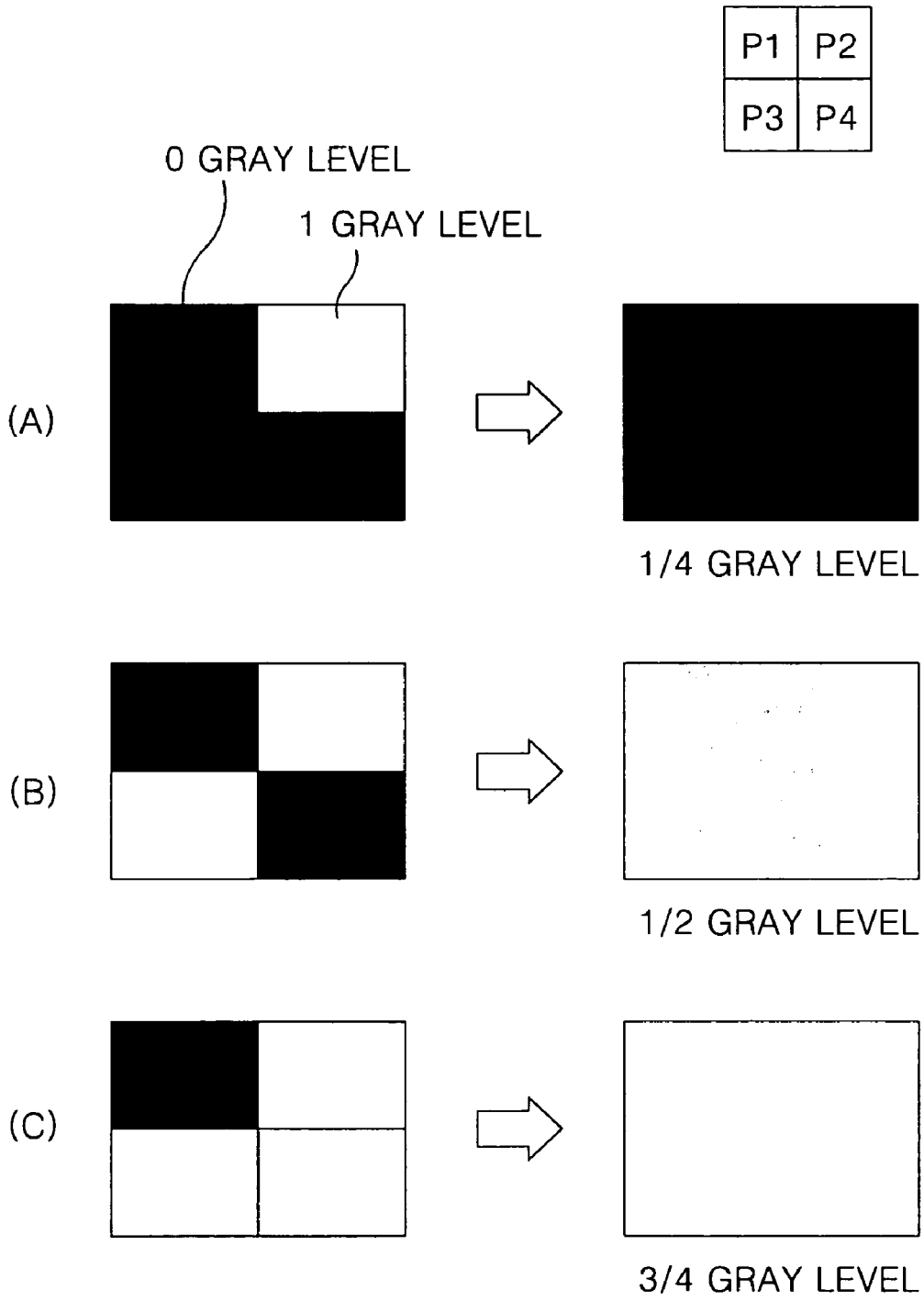
FIG. 10 is an exemplary diagram showing one example of dithering.

As shown in FIG. 10, the dithering method assumes that there is a unit pixel window having four pixels P1, P2, P3 and P4. If the three pixels P1, P3 and P4 within the unit pixel window display the '0' gray scale level and the pixel P2 displays the '1' gray scale level, an observer feels a '¼' gray scale level in the unit pixel window for the corresponding period, as shown in FIG. 10A. On the other hand, as shown in FIG. 10B, if the two pixels P1, P4 within the unit pixel window display the '0' gray scale level and the other two pixels P2 and P3 display the '1' gray scale level, the observer feels a '½' gray scale level in the unit pixel window for the corresponding period. If one pixel P1 within the unit pixel window displays the '0' gray scale level and the other three pixels P2, P3 and P4 display the '1' gray scale level, the observer feels a '¾' gray scale level in the unit pixel window for the corresponding period, as shown in FIG. 10C. The first exemplary compensation method according to the fifth exemplary embodiment of the present invention modulates the data which are to be displayed in the panel defect location by dithering. A detailed explanation for the data modulation using the dithering will be provided in reference to the first exemplary compensation circuit of the fifth exemplary embodiment later.

The exemplary embodiments of the present invention not only uses each of the frame rate control and dithering, but also adjust the data at the panel defect location by combining the frame rate control with the dithering. As shown in FIGS. 11A to 11C, the exemplary embodiments of the present invention can combine the frame rate control and dithering together in order to minimize the deteriorated resolution appearing in the dithering and a flicker phenomenon generated in the frame rate control. As shown in FIGS. 11A to 11C, a unit pixel window including four pixels P1, P2, P3, and P4 are sequentially displayed for four frames. As shown in FIG. 11A, if the unit pixel window displays the '¼' gray scale level, where the '1' gray scale level is displayed, during one pixel and further is made for all four frames, the observer feels that the gray scale level of the unit pixel window is the '¼' gray scale level for the four frames, while not feeling the flicker and the resolution deterioration. On the other hand, if the unit pixel window displays the '½' gray scale level or the '¾' gray scale level while two or three pixels, where the '1' gray scale level is displayed, are made to be different every frame for the four frames, the observer feels that the gray scale level of the unit pixel window is the '½' or '¾' gray scale level for the four frames (FIGS. 11B and 11C), and again the observer does not feel the flicker and the resolution deterioration. In the present invention, both the number of frames of the frame rate control, and the number of pixels included in the unit pixel window in the dithering can be adjusted. A detailed discussion for the first exemplary compensation method of the sixth exemplary embodiment will be provided in reference to the first exemplary compensation circuit of the sixth exemplary embodiment later.

Figure 12A:
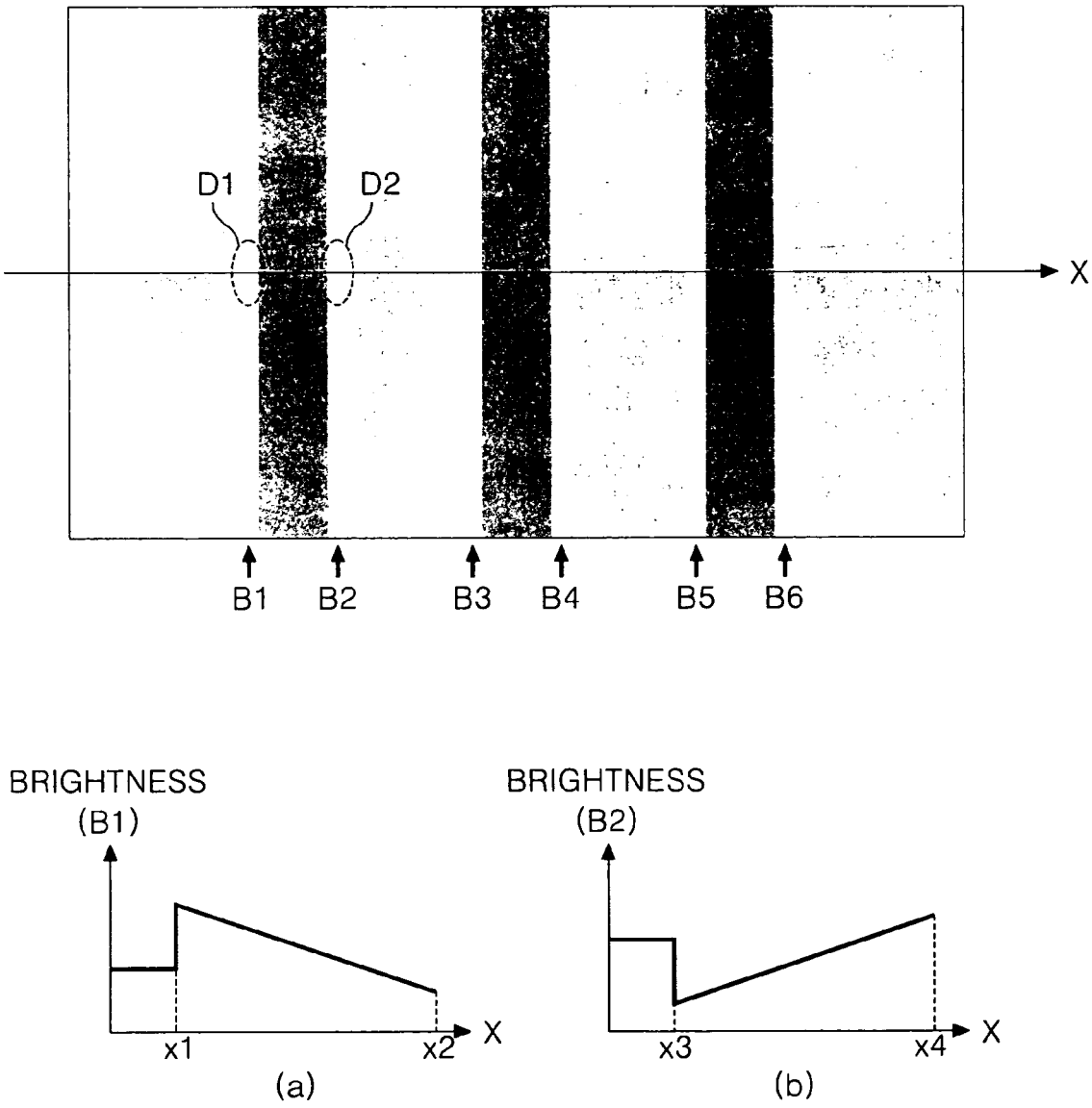
FIGS. 12A to 12C are exemplary diagrams showing the first exemplary embodiment of a compensation pattern in accordance with a noise pattern.
Figure 12B:
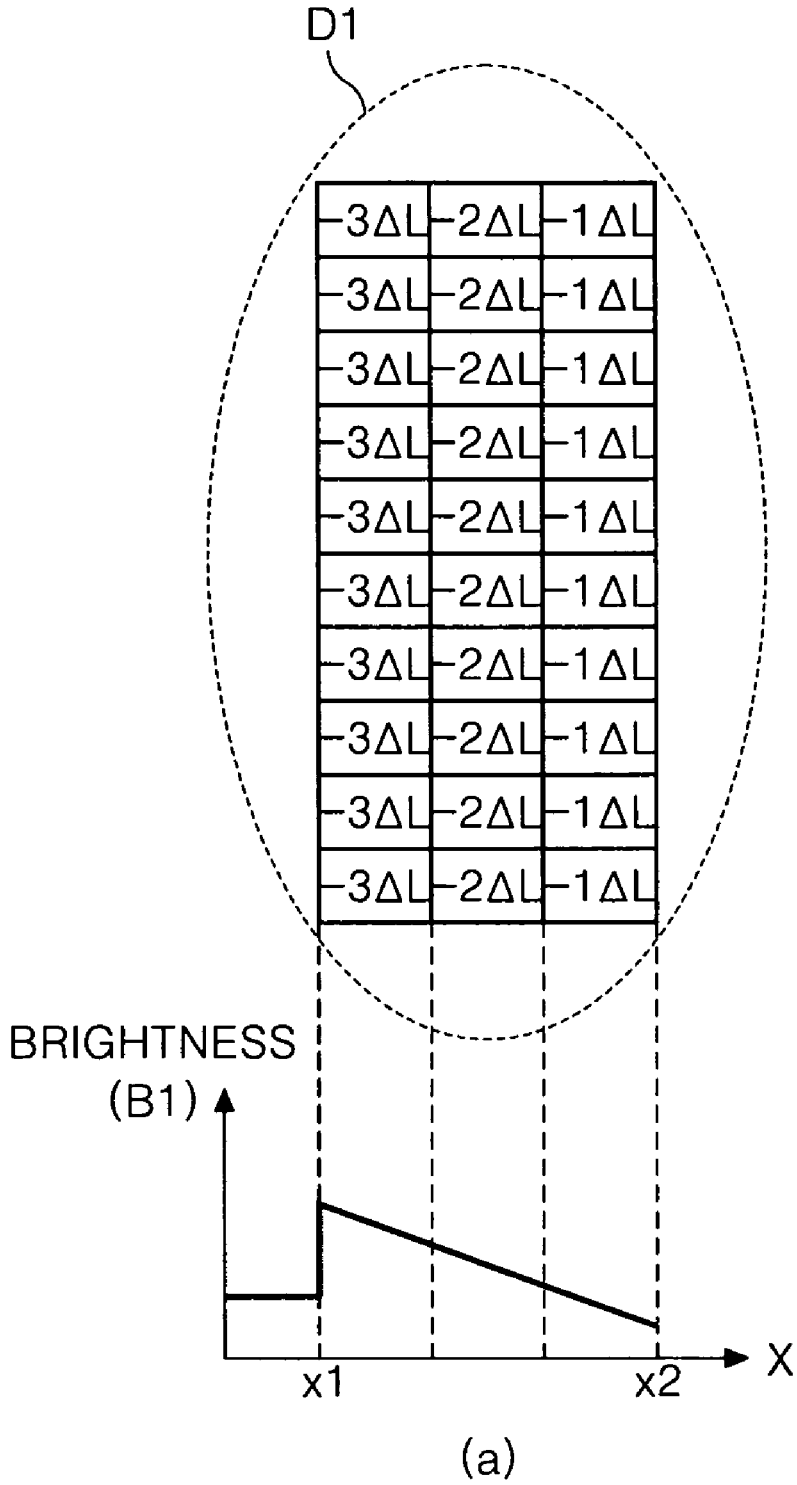
Figure 12C:
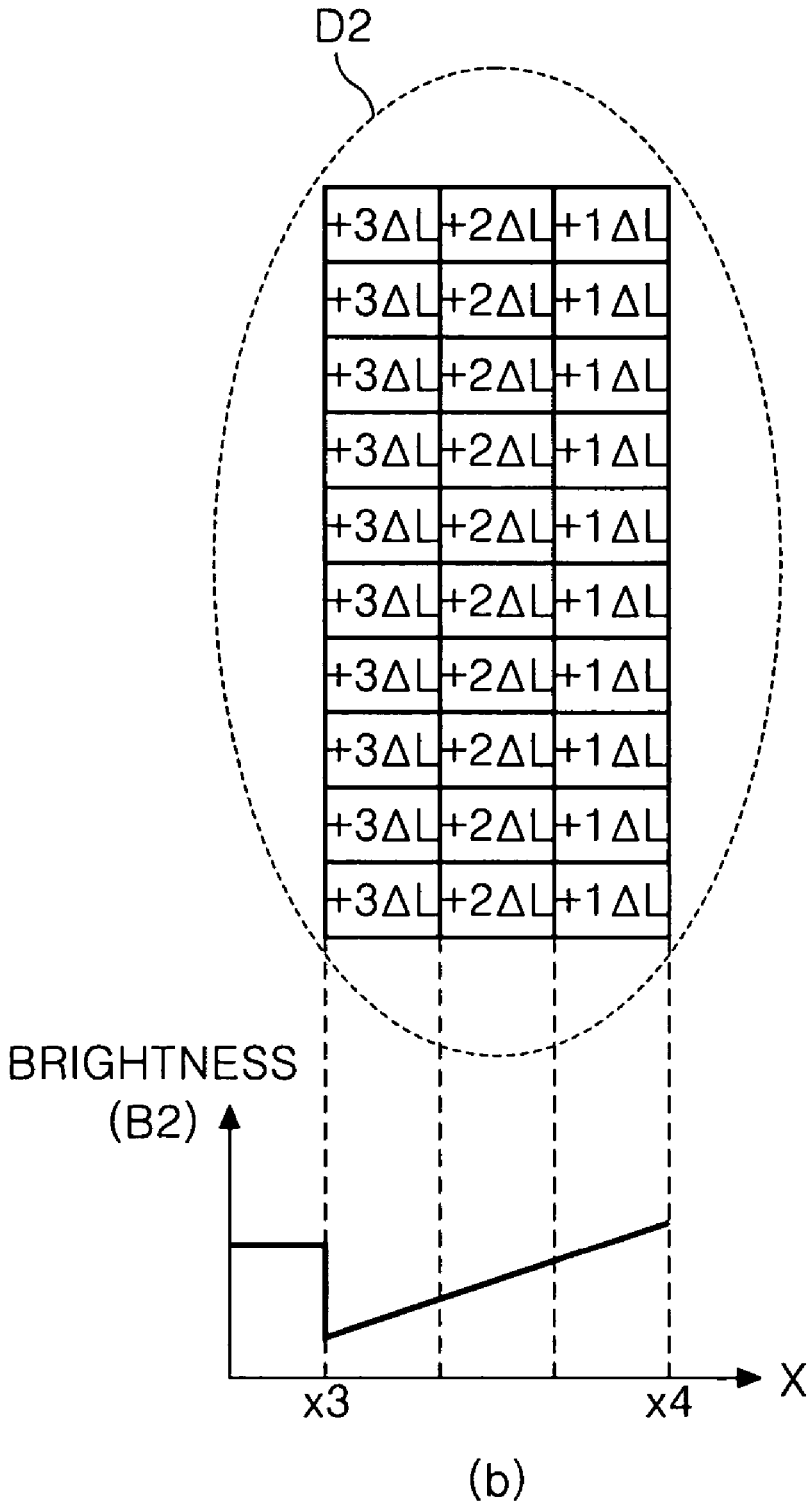

Referring to FIG. 12A, the compensation pattern of the second exemplary compensation method according to the first exemplary embodiment defines the compensation value as follows. The compensation value for the pixels located between ×1 and ×2 is reduced by the slope of k×ΔL (FIGS. 12A (*a*) and 12B) from ×1 to ×2. Further, as shown in FIG. 12A (b), when a boundary brightness is decreased abnormally at ×3 then increases brightness as it approaches ×4, the compensation value is increased by the slope of k×ΔL (FIGS. 12A (*b*) and 12C), thereby increasing the brightness from ×3 to ×4. The sub-divided rectangles of FIGS. 12B and 12C defines the compensation values when the slope of k×ΔL is applied. Here, 'k' represents a positive integer and ΔL is defined in advance.

Figure 13A:
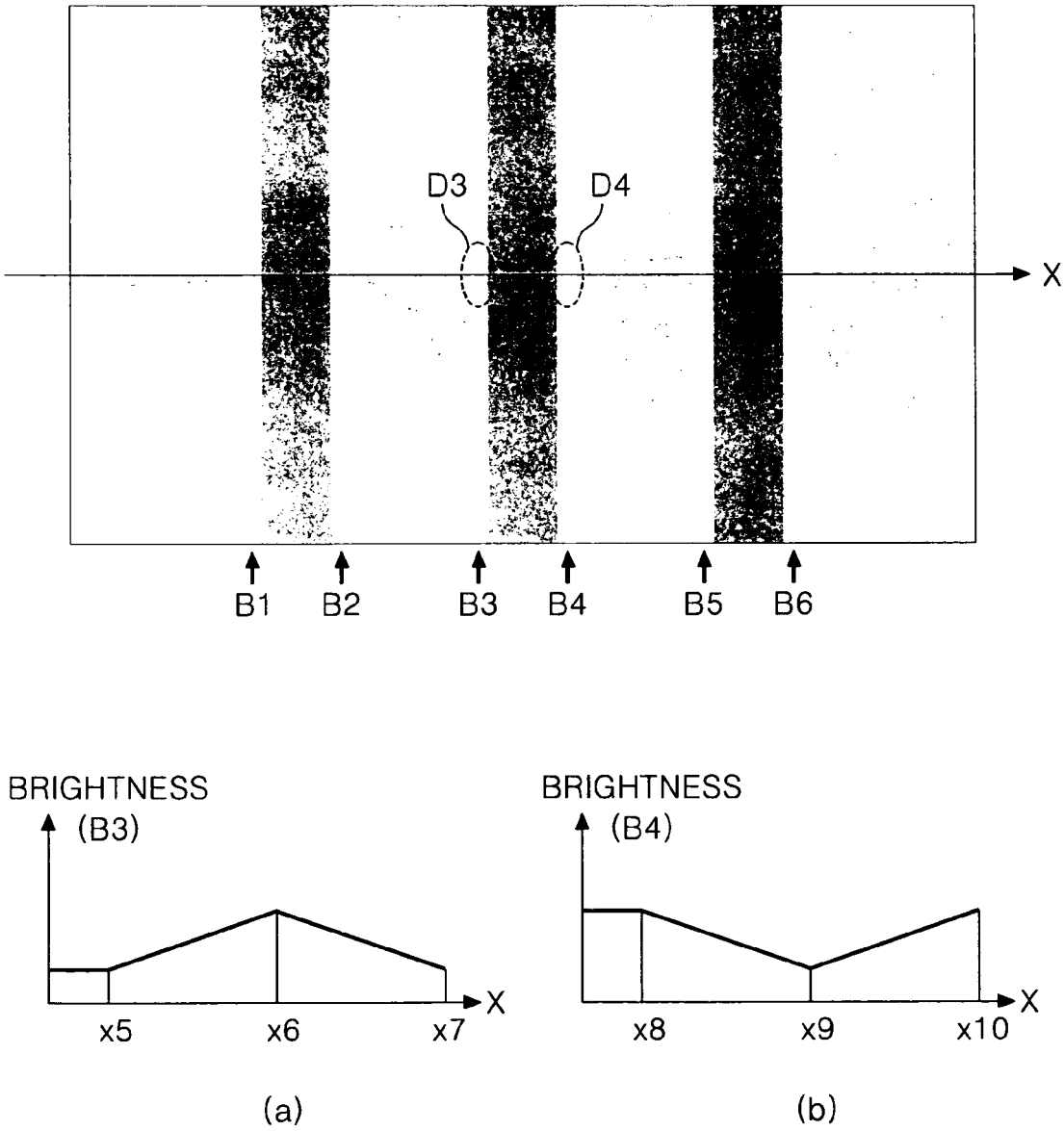
FIGS. 13A to 13C are exemplary diagrams showing a second exemplary embodiment of a compensation pattern in accordance with a noise pattern.
Figure 13B:
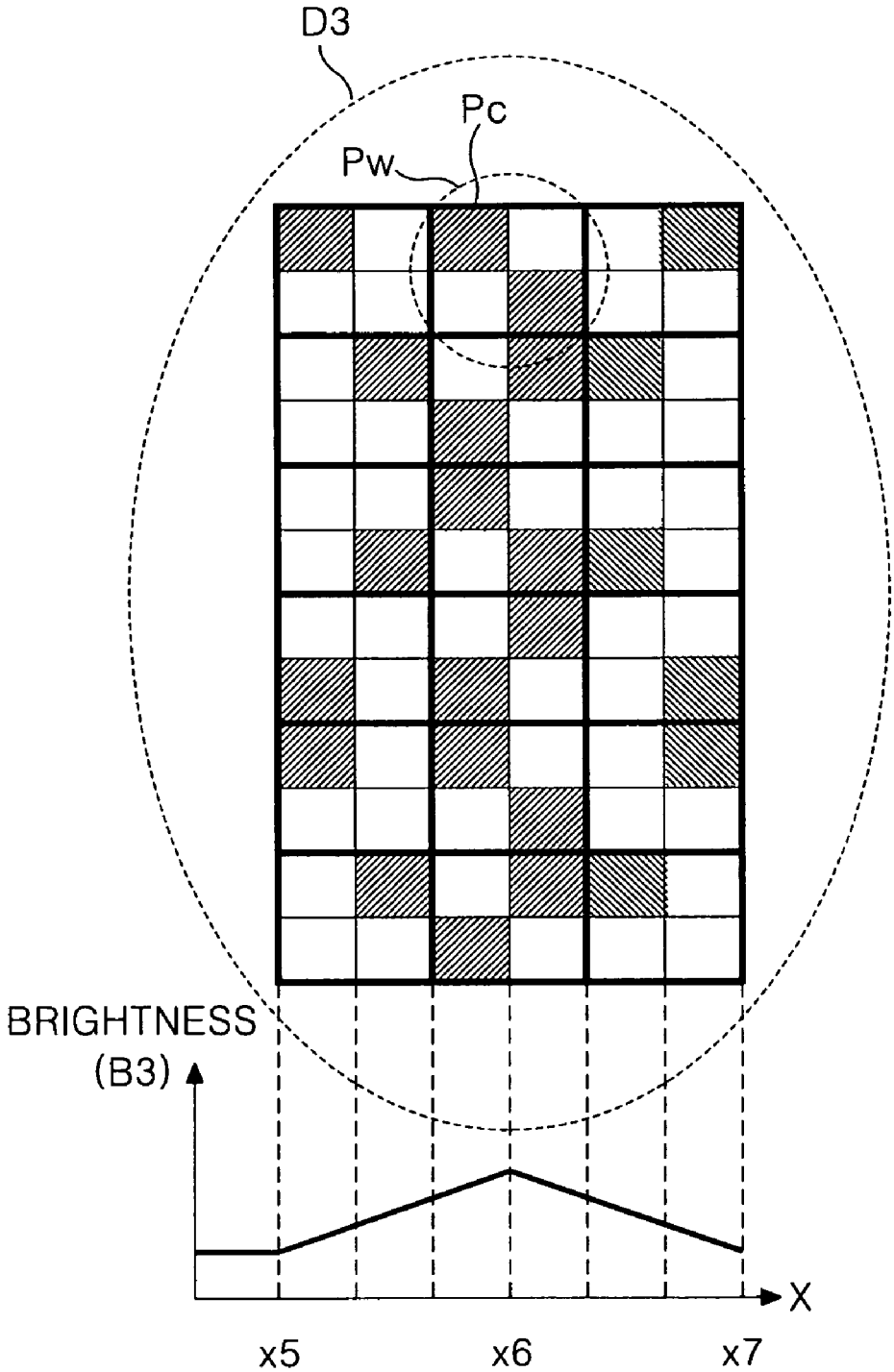
Figure 13C:
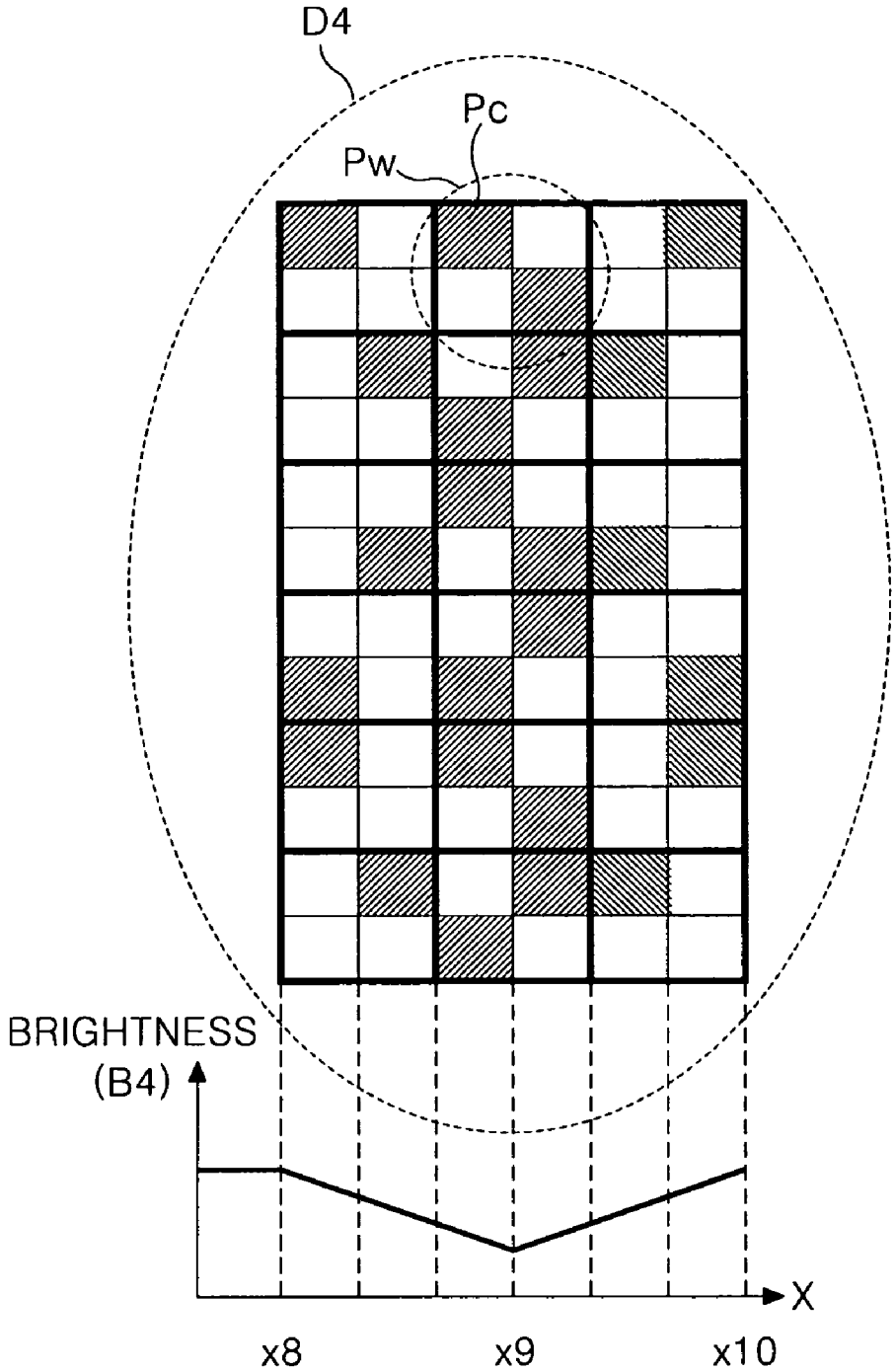

As shown in FIGS. 13A to 13C, the compensation pattern of the second exemplary compensation method according to the second exemplary embodiment of the present invention defines the compensation value as follows. As shown in FIG. 13A (a), the brightness gradually increases from ×5 to ×6 and gradually decreases from ×6 to ×7, such that highest noise is formed at ×6. In the second exemplary compensation method, the compensation value reduces the brightness in the arbitrary number of pixels. For example, as shown in FIG. 13B, a plurality of unit pixel windows each having four pixels in a 2×2 matrix is provided between ×5 and ×7. The unit pixel windows at edges of the compensation width ×5 and ×7 have a compensation value lower than that of the unit pixel window at ×6. The compensation value that reduces the brightness of the pixel within the unit pixel window can be set to various values in accordance with the degree of noise such as k×ΔL, e.g., like −3ΔL, −2ΔL, −1ΔL, or the like. On the contrary, the compensation value can be set to increase the brightness of the pixel in the arbitrary number of pixels. As shown in FIG. 13 C, the brightness gradually decreases from ×8 to ×9 and gradually increases from ×9 to ×10, such that the highest noise is formed at ×9. A plurality of unit pixel windows each having four pixels in a 2×2 matrix is provided between ×8 and ×10. The unit pixel windows at edges of the compensation width ×8 and ×10 have a compensation value higher than that of the unit pixel window at ×9. The compensation value that increases the brightness of the pixel within the unit pixel window can be set to various values in accordance with the degree of noise, such as k×ΔL, e.g., like +3ΔL, +2ΔL, +1ΔL, or the like. The compensation pattern of the second exemplary compensation method according to the second exemplary embodiment has an advantage of compensating the noise better than the pattern of the second exemplary compensation method according to the first exemplary embodiment. In the examples described above, the unit pixel window having four pixels in a 2×2 matrix is used. However, number of pixels included in the unit pixel window can be adjusted as desired, for example, a 4×4, 8×8, or other numbered matrix. Especially, in the large-sized panel, it is advantageous to compensate the boundary by forming the compensation pattern with the pixel window inclusive of a large number of pixels like 8×8 so that deterioration of picture quality is prevented.

As discussed above in reference to FIGS. 4-13, and in particular, FIG. 4, the exemplary method includes the first and second modulation processes S5 and S6 with the first and second compensation data, respectively. The two compensation data are judged by the inspection processes provided in steps S1 through S4. Then, displaying the modulated data on the display pane at step S7. Hereinafter, the exemplary flat panel display device and the exemplary picture quality controlling device according to the exemplary embodiments of the present invention will be discussed in reference to FIGS. 14 to 23.

Figure 14:
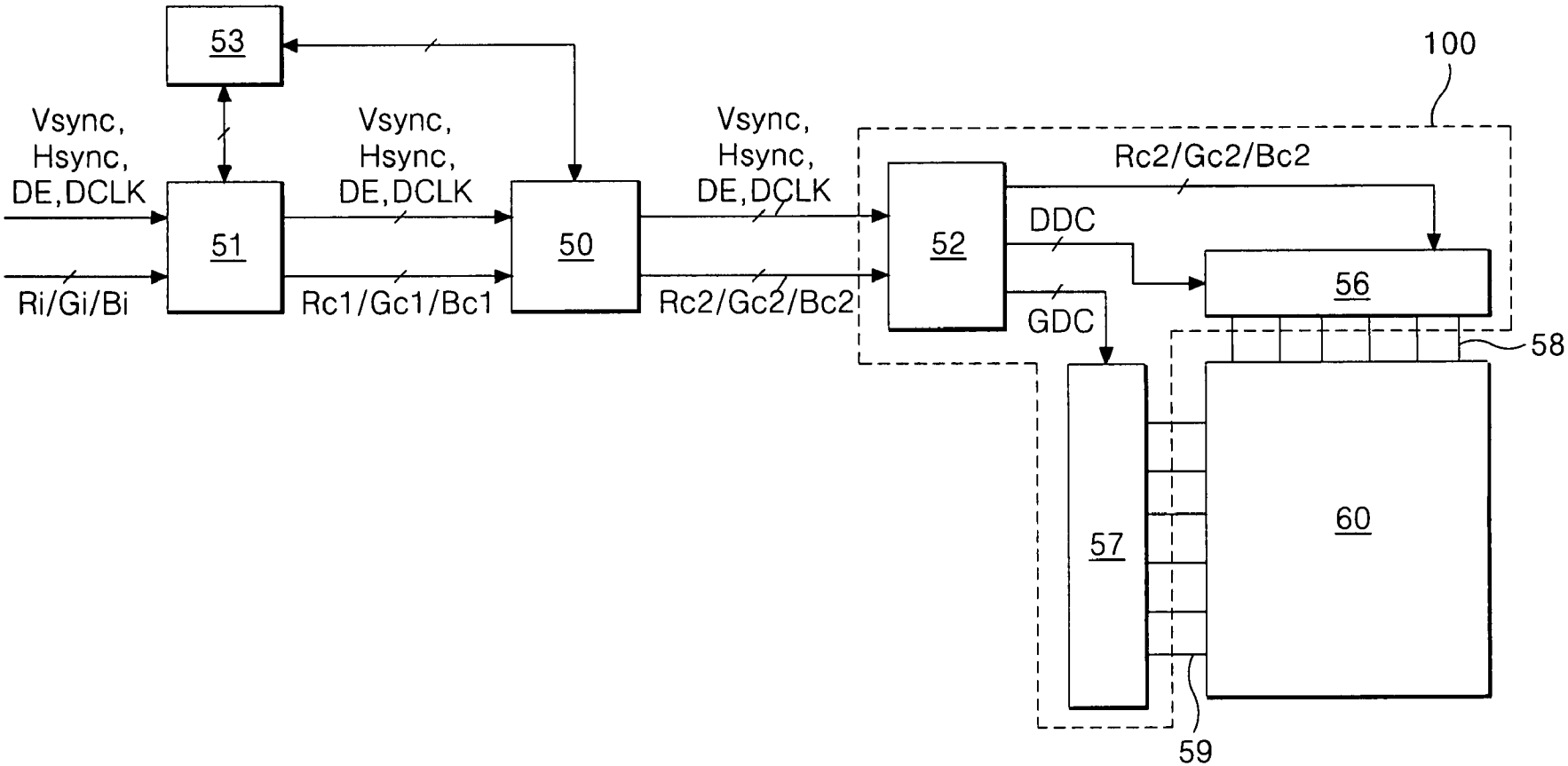
FIG. 14 is an exemplary flat panel display device and a picture quality controlling apparatus according to an exemplary embodiment of the present invention.

As shown in FIG. 14, a flat panel display device according to the exemplary embodiment of the present invention includes a flat panel display panel 60 where a plurality of data lines 58 cross a plurality of scan lines 59 to form pixels arranged in a matrix. Each pixel is driven by a digital video data supplied to the data lines 58 in response to a scan pulse supplied to the scan lines 59. A memory 53 stores the first and second location data and the first and second compensation data that are used to compensate the boundary noise and the panel defect on the flat panel display panel 60. A first compensation circuit 51 generates a first correction digital video data Rc1/Gc1/Bc1 by modulating the input digital video data Ri/Gi/Bi which are to be supplied to the flat panel display panel using the first compensation data. A second compensation circuit 50 generates a second correction digital video data Rc2/Gc2/Bc2 by modulating the first correction digital video data using the second compensation data, and a driver 100 for driving the flat panel display panel 60 by the second correction digital video data Rc2/Gc2/Bc2.

The driver 100 includes a data drive circuit 56 to convert the digital video data into the analog gamma compensation voltage and to supply the compensated digital video data to the data lines 58, a gate drive circuit 57 for supplying a scan signal to the scan lines 59, and a timing controller 52 which generates a control signals GDC and DDC to control the data drive circuit 56 and the gate drive circuit 57. The timing controller 52 also supplies the second correction digital video data Rc2/Gc2/Bc2 to the data drive circuit in accordance with the clock signal.

The timing controller 52 supplies the digital video data Rc2/Gc2/Bc2 modulated by the first and second compensation circuits 50, 51 and the un-modulated digital video data Ri/Gi/Bi to the the data drive circuit 56. The timing controller 52 generates a data drive control signal DDC, which controls the operation timing of the data drive circuit 56 and a gate drive control signal GDC, which controls the operation timing of the gate drive circuit 57 by use of vertical and horizontal synchronization signals Vsync, Hsync, the dot clock DCLK, and the data enable signal DE. The data drive circuit 56 converts the compensated digital video data Rc2/Gc2/Bc2 compensated from the timing controller 52 into an analog voltage or current which can express gray scale levels, and supplies the data to the data lines 58. The scan drive circuit 57 sequentially applies the scan pulse to the scan lines, which is controlled by the timing controller 52 to select a horizontal line of pixels which are to be displayed. The exemplary flat panel display device may be a liquid crystal display LCD, field emission display FED, plasma display panel PDP, and an organic light emitting diode OLED.

Figure 15:
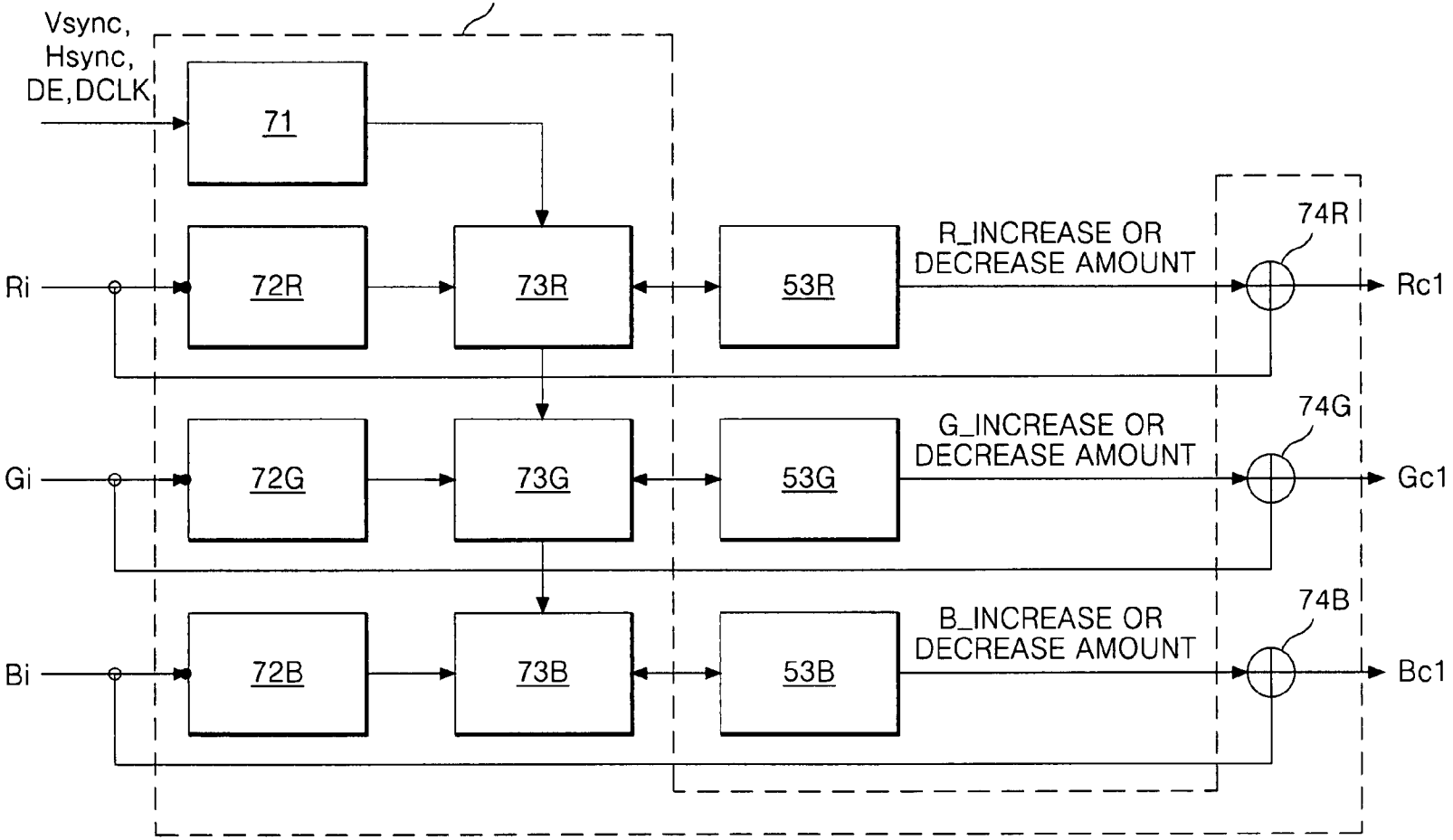
FIG. 15 is a block diagram showing an exemplary compensation circuit according to the first exemplary embodiment of the present invention.

FIG. 15 is a diagram for explaining a first compensation circuit 51 and the operation thereof. As shown in FIG. 15, the first compensation circuit 51 according to the first exemplary embodiment of the present invention includes a location judging portion 71, gray scale level judging portions 72R, 72G and 72B, address generators 73R, 73G and 73B, and calculators 74R, 74G and 74B. The EEPROM 53 includes a first to third EEPROM 53R, 53G and 53B, each storing the compensation data CD and the location data PD for red R, green G and blue B, respectively. The data stored at the first to third EEPROMs 53 are different for each EEPROM in the same location and the same gray scale level when the panel defect is compensated by the unit of sub-pixel or during color correction.

On the other hand, the data are the same in each of the EEPROMs in the same location and the same gray scale level when the panel defect is compensated by the unit of pixels including three sub-pixels of red, green and blue or during brightness correction. The location judging portion 71 judges the display location of the input digital video data Ri/Gi/Bi using the vertical/horizontal synchronization signals Vsync, Hsync. The input digital video data Ri/Gi/Bi enable signal DE and the dot clock DCLK. The gray scale level judging portions 72R, 72G and 72B analyze the gray scale level of the input digital video data Ri/Gi/Bi of red R, green G and blue B. The address generator 73R, 73G and 73B generate a read address for reading the compensation data CD of the panel defect location to supply to the EEPROM 53R, 53G and 53B if the display location of the input digital video data Ri/Gi/Bi corresponds to the panel defect location by referring to the location data PD of the EEPROM 53R, 53G and 53B. The compensation data CD outputted from the EEPROM 53R, 53G and 53B in accordance with the address are supplied to the calculators 74R, 74G and 74B. The calculators 74R, 74G and 74B add the compensation data CD to or subtract the compensation data CD from the input digital video data Ri/Gi/Bi to modulate the input digital video data Ri/Gi/Bi which is to be displayed in the panel defect location. Here, the calculators 74R, 74G and 74B may include a multiplier or a divider which can multiply the compensation data CD to or divide the compensation data CD from the input digital video data Ri/Gi/Bi.

Figure 16:
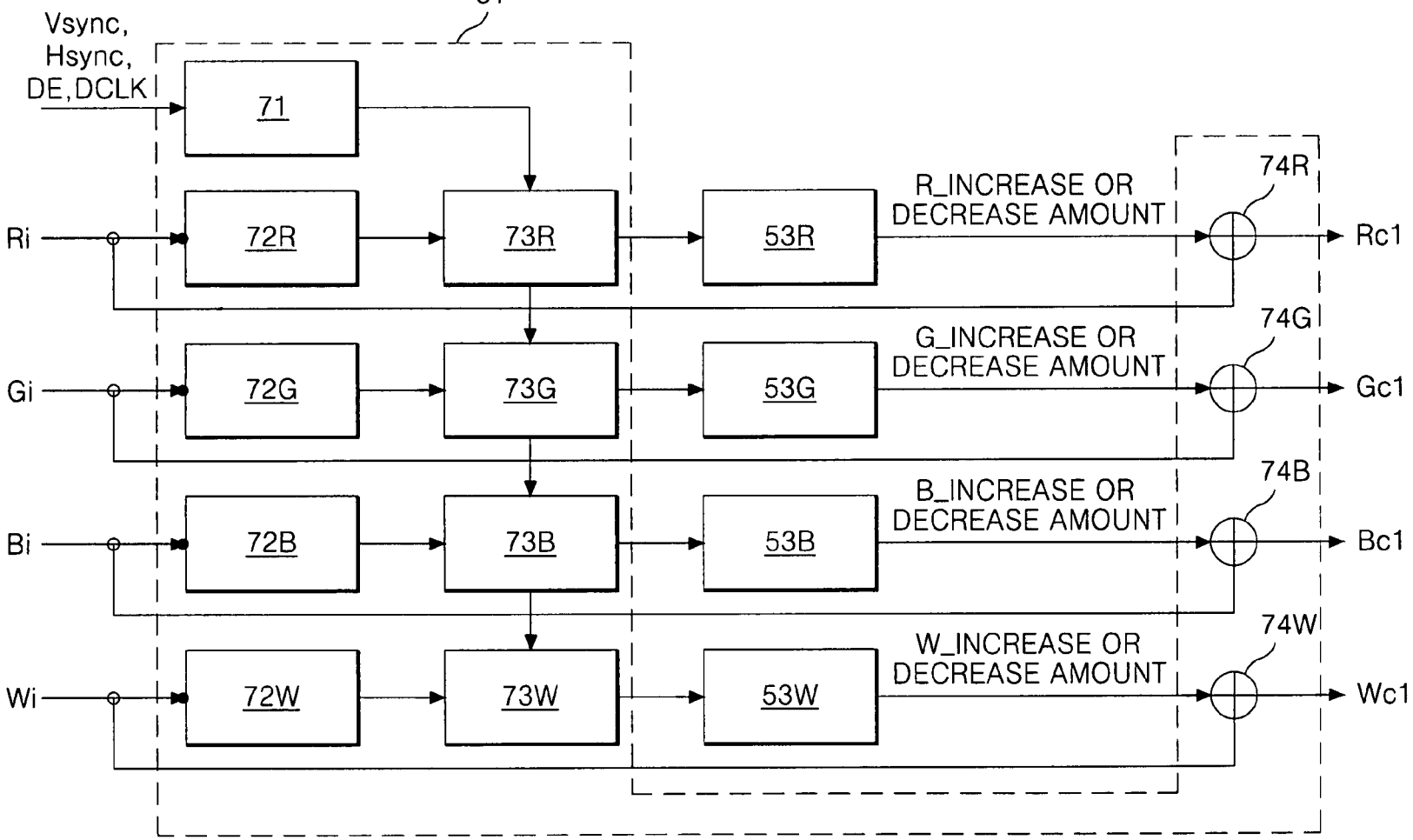
FIG. 16 is a block diagram showing an exemplary compensation circuit according to the second exemplary embodiment of the present invention.

As shown in FIG. 16, a first compensation circuit 51 according to the second exemplary embodiment of the present invention further includes the gray scale level judging portion 72W, the address generator 73W and the calculator 74W. The EEPROM 53 of the second exemplary embodiment further includes a third EEPROM 53W where the compensation data for the white data in the panel defect location is stored in a form of lookup table. If the white data Wi are compensated in this way, the brightness compensation in the panel defect location can be made more easily. On the other hand, the white data Wi are determined from the brightness information Y which is calculated by having the input digital video data Ri/Gi/Bi of red, green, and blue as a variable.

Figure 17:
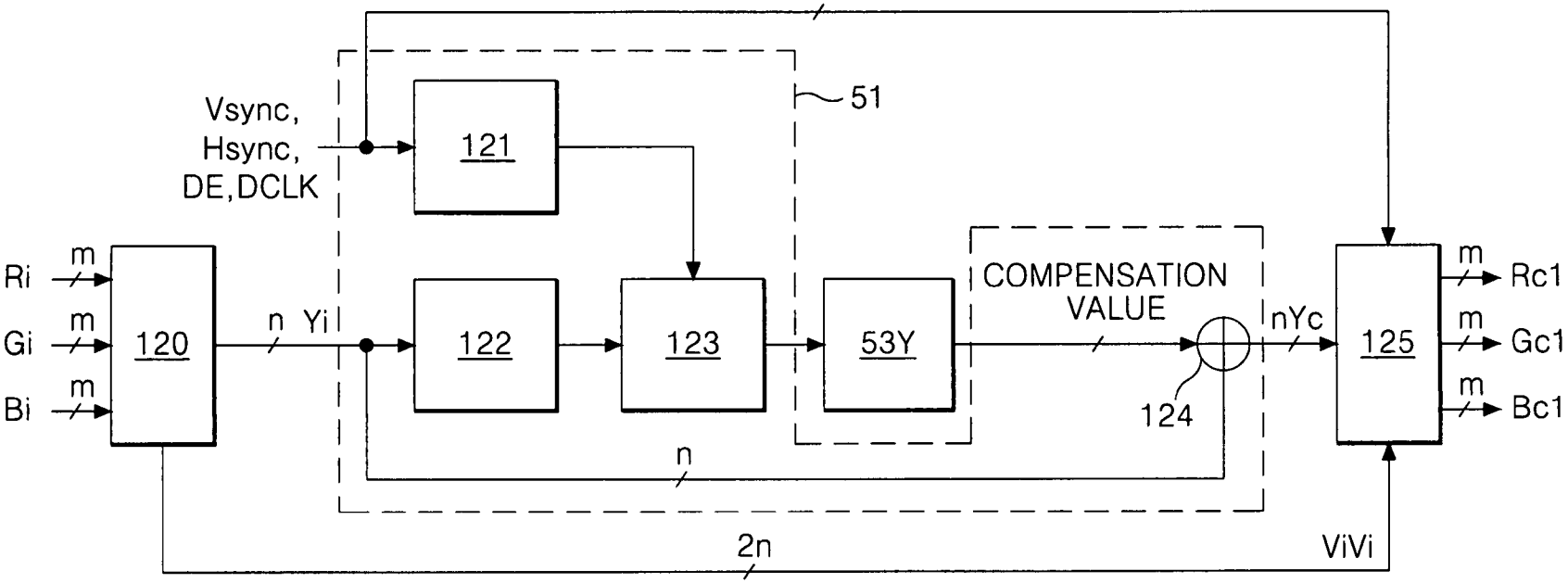
FIG. 17 is a block diagram showing an exemplary compensation circuit according to a third exemplary embodiment of the present invention.

FIG. 17 represents a first compensation circuit 51 and the EEPROM 53Y according to a third exemplary embodiment of the present invention. Referring to FIG. 17, the first compensation circuit 51 according to the third embodiment of the present invention includes an RGB to YUV converter 120, a location judging portion 121, a gray scale level judging portion 122, an address generator 123, a calculator 124, and a YUV to RGB converter 125. The EEPROM 53Y stores the panel defect brightness compensation data for each location and for each gray scale level that is modulating the brightness information Yi of the input digital video data Ri/Gi/Bi, which are to be displayed at the panel defect location.

The RGB to YUV converter 120 calculates a color difference information UiVi and a brightness information Yi of n/n/n (n is an integer larger than m) bits using the following Mathematical Formulas 1 to 3, which take the input digital video data Ri/Gi/Bi having m/m/m bits.

$$Yi=0.299Ri+0.587Gi+0.114Bi \quad \text{Mathematical Formula 1}$$

$$Ui=-0.147Ri-0.289Gi+0.436Bi=0.492(Bi-Yi) \quad \text{Mathematical Formula 2}$$

$$Vi=0.615Ri-0.515Gi-0.100Bi \quad \text{Mathematical Formula 3}$$

The location judging portion 121 judges the display location of the input digital video data (Ri/Gi/Bi) using vertical and horizontal synchronization signals Vsync and Hsync, a data enable signal DE and a dot clock DCLK. The gray scale level judging portion 122 analyzes the gray scale level of the input digital video data Ri/Gi/Bi using the brightness information from the RGB to YUV converter 120. The address generator 127 generates a read address for reading the panel defect brightness compensation data of the panel defect location. This read address is supplied to the EEPROM 53Y if the display location of the input digital video data Ri/Gi/Bi corresponds to the panel defect location. This correspondence is obtained by the panel defect location data of the EEPROM 53Y. The output panel defect brightness compensation data from the EEPROM 53Y are supplied to the calculator 124 according to the address.

The calculator 124 adds the panel defect brightness compensation data of the EEPROM 53Y to or subtracts the panel defect brightness compensation data of the EEPROM 53Y from the brightness information Yi of n bits in the RGB to YUV converter 120. This process is for modulating the brightness of the input digital video data Ri/Gi/Bi to be displayed at the panel defect location. Here, the calculator 124 may instead include a multiplier or divider which can multiply the panel defect brightness compensation data to or divide the panel defect brightness compensation data from the brightness information Yi of n bits. The brightness information Yc modulated by the calculator 124 increases or decreases the extended brightness information Yi of n bits. Therefore, it is possible to adjust the brightness of the input digital video data Ri/Gi/Bi to the factional portion. The YUV to RGB converter 125 calculates the modulated data Rc/Gc/Bc of m/m/m bits using Mathematical Formulas 4 to 6. Mathematical Formulas 4 to 6.

$$R=Yc+1.140Vi \quad \text{Mathematical Formula 4}$$

$$G=Yc-0.395Ui-0.581Vi \quad \text{Mathematical Formula 5}$$

$$B=Yc+2.032Ui \quad \text{Mathematical Formula 6}$$

The YUV to RGB converter 125 takes the brightness information Yc modulated by the calculator 124 and the color difference information UiVi from the RGB to YUV converter 120 as variables. In this way, the panel defect compensation circuit according to a third exemplary embodiment of the present invention converts the R/G/B video data, which is to be displayed in a panel defect location, into a brightness component and a color difference component. By noticing that a human eye is more sensitive to the brightness difference than to the color difference, the panel defect compensation circuit according to the third exemplary embodiment of the present invention adjusts the brightness of the panel defect location by extending the number of bits of Y data which include the brightness information among them, thereby enabling control of the brightness at the panel defect location of the flat panel display.

Figure 18:
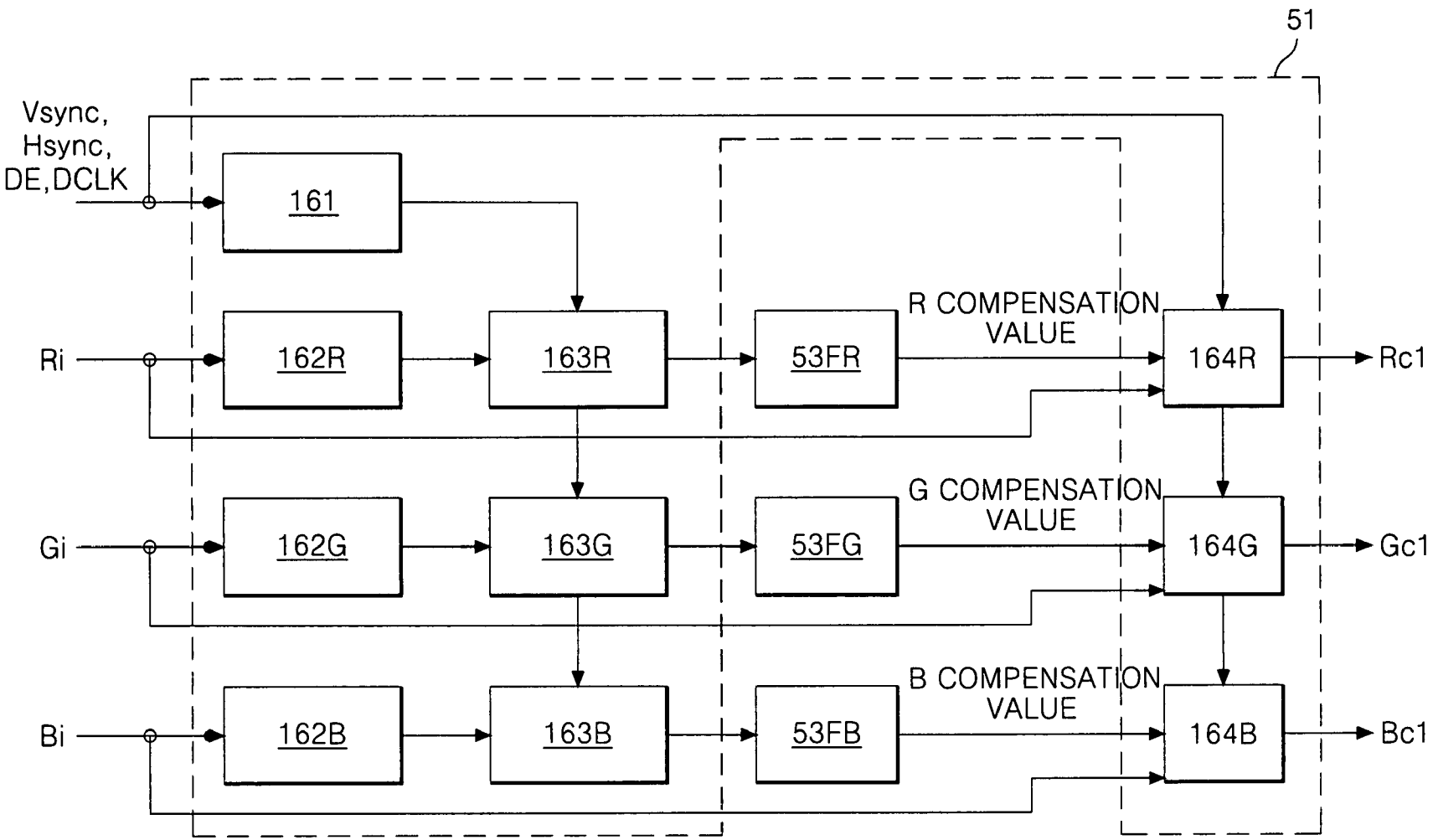
FIG. 18 is a block diagram showing an exemplary compensation circuit according to a fourth exemplary embodiment of the present invention.

FIG. 18 represents a first compensation circuit 51 and an EEPROM 53 according to a fourth exemplary embodiment of the present invention. As shown in FIG. 18, the first compensation circuit 51 includes a location judging portion 161, gray scale level judging portions 162R, 162G and 162B, address generators 163R, 163G and 163B, and FRC controllers 164R, 164G and 164B. The EEPROM 53 includes first to third EEPROM 53FR, 53FG and 53FB, each storing the compensation data CD and the location data PD thereof for colors red R, green G and blue B, respectively. The location judging portion 161 judges the display location of the input digital video data Ri/Gi/Bi using vertical and horizontal synchronization signals Vsync and Hsync, a data enable signal DE and a dot clock DCLK.

The gray scale level judging portions 162R, 162G and 162B analyze the gray scale level of the input digital video data Ri/Gi/Bi for colors red R, green G and blue B, respectively. The address generators 163R, 163G and 163B generate a read address for reading the compensation data CD of the panel defect location to supply to the EEPROMs 53FR, 53FG and 53FB if the display location of the input digital video data Ri/Gi/Bi corresponds to the panel defect location by referring to the location data PD of the EEPROMs 53R, 53G and 53B. The compensation data CD outputted from the EEPROMs 53FR, 53FG and 53FB are supplied to the FRC controllers 164R, 164G and 164B according to the address.

The FRC controllers 164R, 164G and 164B modulate the data which are to be displayed at the panel defect location by increasing or decreasing the input digital video data Ri/Gi/Bi by the compensation data CD from the EEPROMs 53FR, 53FG and 53FB. The number and sequence of frames where the compensation data CD are increased or decreased are made different according to the panel defect compensation value, thereby dispersing the compensation data CD to a plurality of frames, as shown in FIG. 9. For example, if the compensation data CD are in the '0.5' gray scale levels, the FRC controllers 164R, 164G and 164B compensate the '0.5' gray scale level by adding the '1' gray scale level to the data of the corresponding panel defect location pixel for two frame periods among the four frames. The FRC controllers 164R, 164G and 164B have circuit configurations as shown FIG. 18. While FIG. 18 represents a first FRC controller 164R for correcting red data in detail, second and third controllers 164G and 164B for correcting green and blue data in detail have substantially the same circuit configuration.

Figure 19:
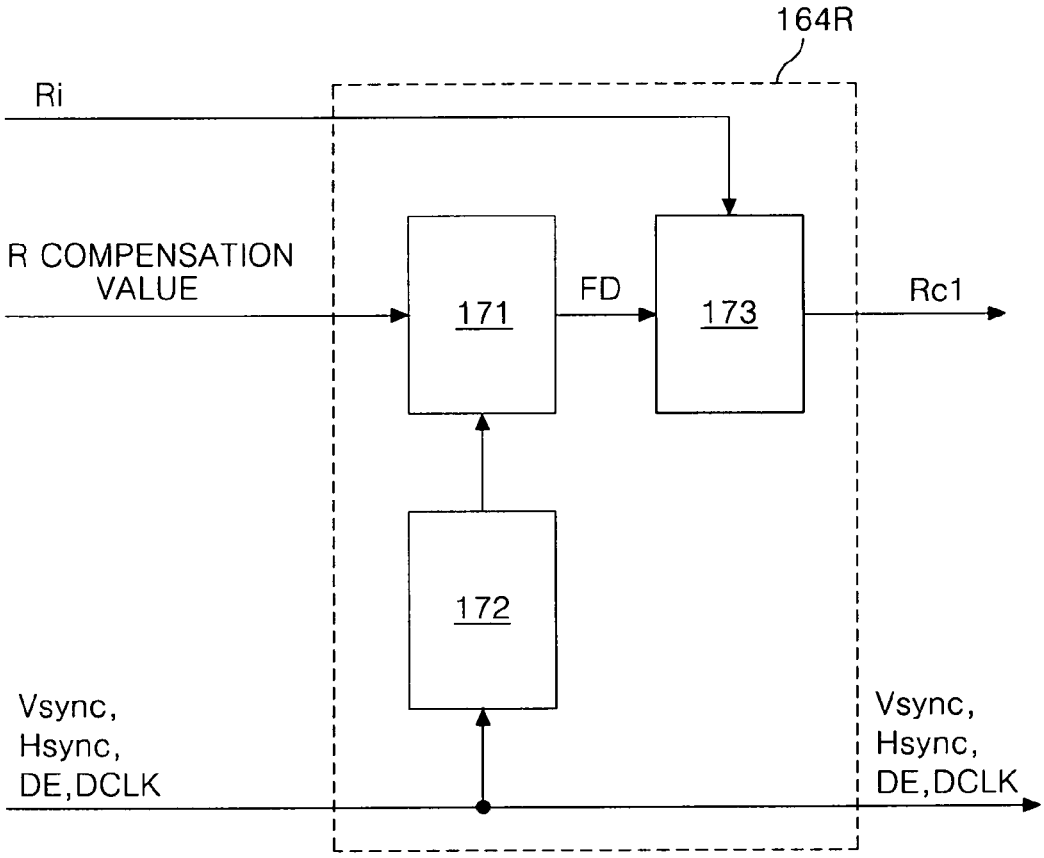
FIG. 19 is a block diagram showing, in detail, a first exemplary FRC controller of FIG. 18.

As shown in FIG. 19, the first FRC controller 164R includes a compensation value judging portion 171, a frame number sensing portion 172 and a calculator 173. The compensation value judging portion 171 judges the R compensation value and generates a FRC data FD. The FRC data FD is calculated by dividing the compensation value by the number of frames. For example, let us consider four frames to be one frame group. The R panel defect compensation data '00' is pre-set to be recognized as the '0' gray scale level. The R panel defect compensation data '01' is pre-set to be recognized as the '¼' gray scale level. The R panel defect compensation data '10' is pre-set to be recognized as the '½' gray scale level. The R panel defect compensation data '11' is pre-set to be recognized as the '¾' gray scale level. Under this condition, the compensation value judging portion 171 judges the R panel defect compensation data '01' as the data that the '¼' gray scale level is to be added to the display gray scale level of the data of the corresponding panel defect location. First, the gray scale level of the R panel defect compensation data is judged. In order to compensate the '¼' gray scale level to the input digital video data Ri/Gi/Bi, the compensation value judging portion 171 generates the FRC data FD of '1' in one frame period for the '1' gray scale level. This one frame is added to any one frame among the first to fourth frames and the FRC data FD of '0' for the remaining three frame periods is generated.

Figure 20:
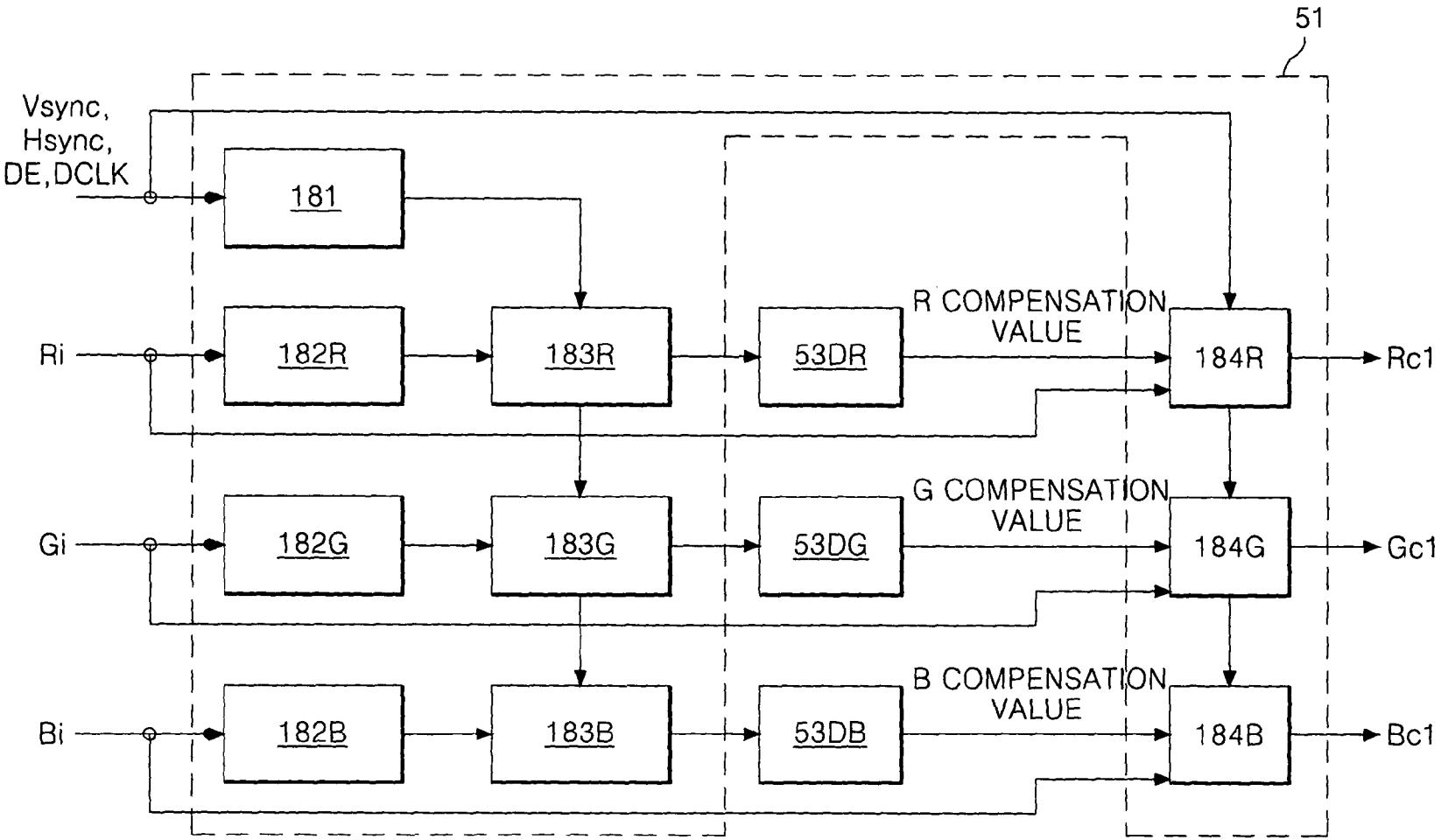
FIG. 20 is a block diagram showing an exemplary compensation circuit according to a fifth exemplary embodiment of the present invention.

The frame number sensing portion 172 senses the number of frames by using one or more of the vertical and horizontal synchronization signals Vsync and Hsync, the dot clock DCLK and the data enable signal DE. For example, as the frame number sensing portion 172 counts the vertical synchronization signal Vsync, it is possible to sense the number of frames. The calculator 173 increases and decreases the input digital video data Ri/Gi/Bi by the FRC data FD to generate the corrected digital video data Rc. The first compensation circuit 51 and the EEPROM 53 according to the fourth exemplary embodiment of the present invention subdivides into 1021 gray scale levels to correct the data which is to be displayed at the panel defect location. Here, it is assumed that the panel defect first compensation circuit 51 and the EEPROM 53 disperse the compensation value temporally by having the input R, G and B digital video data to be 8 bits each. It is further assumed that the four frame periods form one frame group FIG. 20 represents the first compensation circuit 51 and the EEPROM 53 according to a fifth exemplary embodiment of the present invention. As shown in FIG. 20, the first compensation circuit 51 includes a location judging portion 181, gray scale level judging portions 182R, 182G and 182B, address generators 183R, 183G and 183B, and dithering controllers 184R, 184G and 184B. The EEPROM 53 includes first to third EEPROMs 53DR, 53DG and 53DB each of which stores the compensation data CD and the location data PD thereof for colors red R, green G and blue B, respectively. The location judging portion 181 judges the display location of the input digital video data Ri/Gi/Bi by use of vertical and horizontal synchronization signals Vsync and Hsync, a data enable signal DE and a dot clock DCLK. The gray scale level judging portions 182R, 182G and 182B analyze the gray scale level of the input digital video data Ri/Gi/Bi for colors red R, green G and blue B, respectively.

The address generators 183R, 183G and 183B generate read address for reading the compensation data CD of the panel defect location to supply to the EEPROMs 53DR, 53DG and 53DB if the display location of the input digital video data Ri/Gi/Bi correspond to the panel defect location by referring to the location data PD of the EEPROMs 53DR, 53DG and 53DB. The compensation data CD that is output from the EEPROMs 53DR, 53DG and 53DB are supplied to the dithering controllers 184R, 184G and 184B in accordance with the address. The dithering controllers 184R, 184G and 184B disperse the compensation data CD from the EEPROMs 53DR, 53DG and 53DB to each pixel of the unit pixel window including a plurality of pixels to modulate the input digital video data Ri/Gi/Bi which are to be displayed at the panel defect location.

Figure 21:
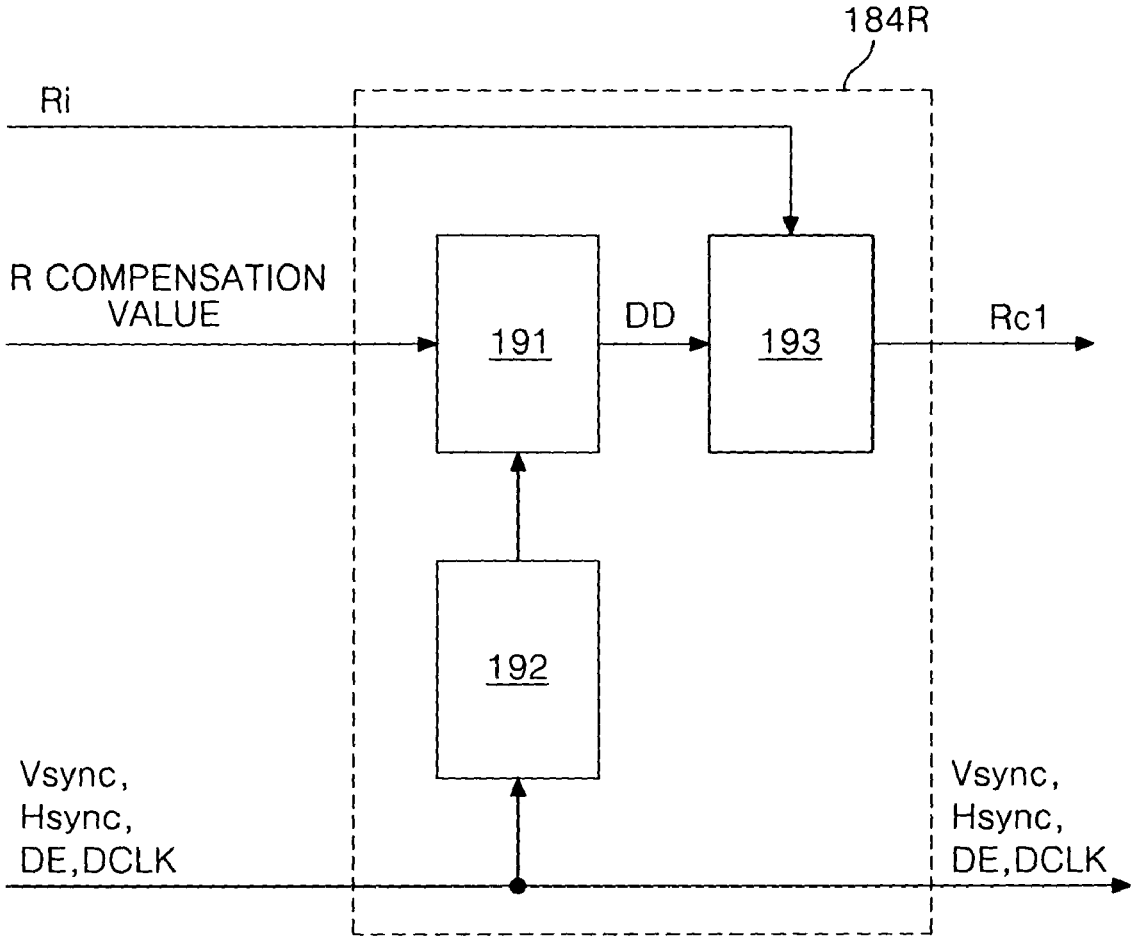
FIG. 21 is a block diagram showing, in detail, a first exemplary dithering controller of FIG. 20.

FIG. 21 represents a first dithering controller 184R for correcting the red data. Second and third dithering controllers 184G and 184B for correcting green and blue data have substantially the same circuit configuration as the first dithering controller 184R. As shown in FIG. 21, the first dithering controller 184R includes a compensation value judging portion 191, a pixel location sensing portion 192 and a calculator 193. The compensation value judging portion 191 judges the R compensation value and generates a dithering data DD by taking the compensation value. This value is further dispersed to the pixels included in the unit pixel window. The compensation value judging portion 191 is programmed to automatically output the dithering data in accordance with the R compensation value.

For example, the compensation value judging portion 191 is pre-programmed for the dithering compensation value of the unit pixel window to be recognized as the '¼' gray scale level if the R compensation value expressed in binary data is '00'. Further, the compensation value judging portion 191 is pre-programmed for the dithering compensation value of the unit pixel window to be recognized as the '½' gray scale level if the R compensation value is '10'. Finally, the compensation value judging portion 191 is pre-programmed for the dithering compensation value of the unit pixel window to be recognized as the '¾' gray scale level if the R compensation value is '11'. Accordingly, the compensation value judging portion 191 generates '1' as the dithering data DD in the pixel location within the unit pixel window, if four pixels are included in the unit pixel window, and the R compensation value is '01'. On the other hand, it generates '0' as the dithering data DD in the rest three pixel locations. The dithering data DD are increased or decreased by the calculator 132 for each pixel location within the unit pixel window.

The pixel location sensing portion 192 senses the pixel location using one or more than the vertical and horizontal synchronization signals Vsync and Hsync, the dot clock DCLK and the data enable signal DE. For example, the pixel location sensing portion 192 counts the horizontal synchronization signal Hsync and the dot clock DCLK. Thus, it is possible to sense the pixel location. The calculator 173 increases and decreases the input digital video data Ri/Gi/Bi by the dithering data DD to generate the corrected digital video data Rc. The first compensation circuit 51 and the EEPROM 53 according to the fifth exemplary embodiment of the present invention can adjust the data, which is to be displayed at the panel defect location, with the compensation value which is subdivided into 1021 gray scale levels for each color of R, G, B, assuming that the unit pixel window is composed of four pixels.

Figure 22:
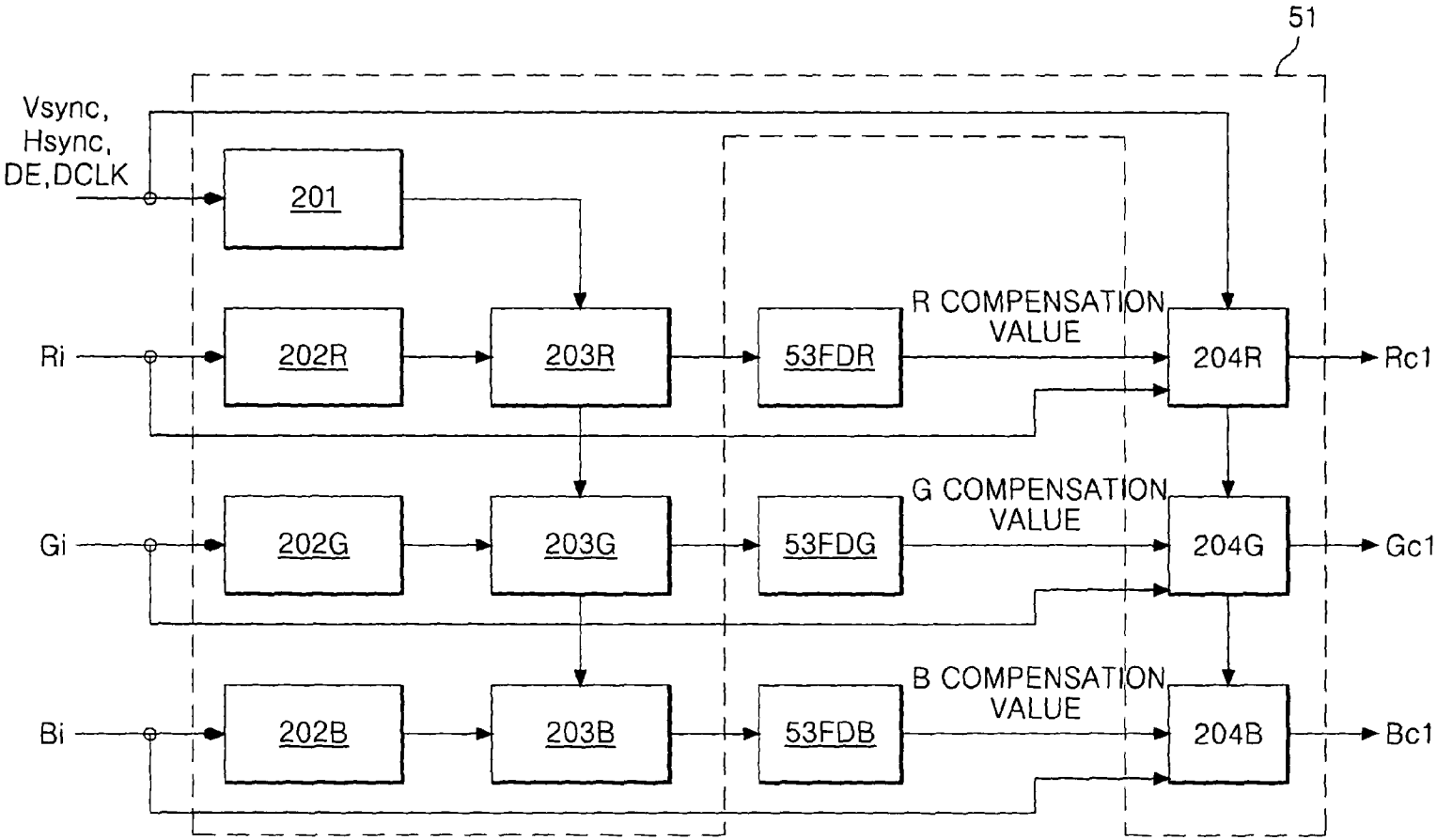
FIG. 22 is a block diagram showing an exemplary compensation circuit according to a sixth exemplary embodiment of the present invention.

FIG. 22 represents the first compensation circuit 51 and the EEPROM 53 according to the sixth exemplary embodiment of the present invention. As shown in FIG. 22, the first compensation circuit 51 includes a location judging portion 201, gray scale level judging portions 202R, 202G and 202B, address generators 203R, 203G and 203B, an FRC and dithering controllers 204R, 204G and 204B. The EEPROM 53 includes first to third EEPROMs 53FDR, 53FDG and 53FDB each of which stores the compensation data CD and the location data PD thereof for each color of red R, green G and blue B, respectively. The location judging portion 201 judges the display location of the input digital video data Ri/Gi/Bi using vertical and horizontal synchronization signals Vsync and Hsync, a data enable signal DE and a dot clock DCLK. The gray scale level judging portions 202R, 202G and 202B analyze the gray scale level of the input digital video data Ri/Gi/Bi for colors red R, green G and blue B.

The address generators 203R, 203G and 203B generate read addresses for reading the compensation data CD of the panel defect location to supply to the EEPROMs 53FDR, 53FDG and 53FDB if the display location of the input digital video data Ri/Gi/Bi corresponds to the panel defect location by referring to the location data PD of the EEPROM 53FDR, 53FDG and 53FDB. The FRC and dithering controller 204R, 204G and 204B disperse the compensation data CD from the EEPROMs 53FDR, 53FDG and 53FDB to each pixel of the unit pixel window including a plurality of pixels. They further disperse the compensation data CD to a plurality of frame periods to modulate the input digital video data Ri/Gi/Bi which is to be displayed at the panel defect location.

Figure 23:
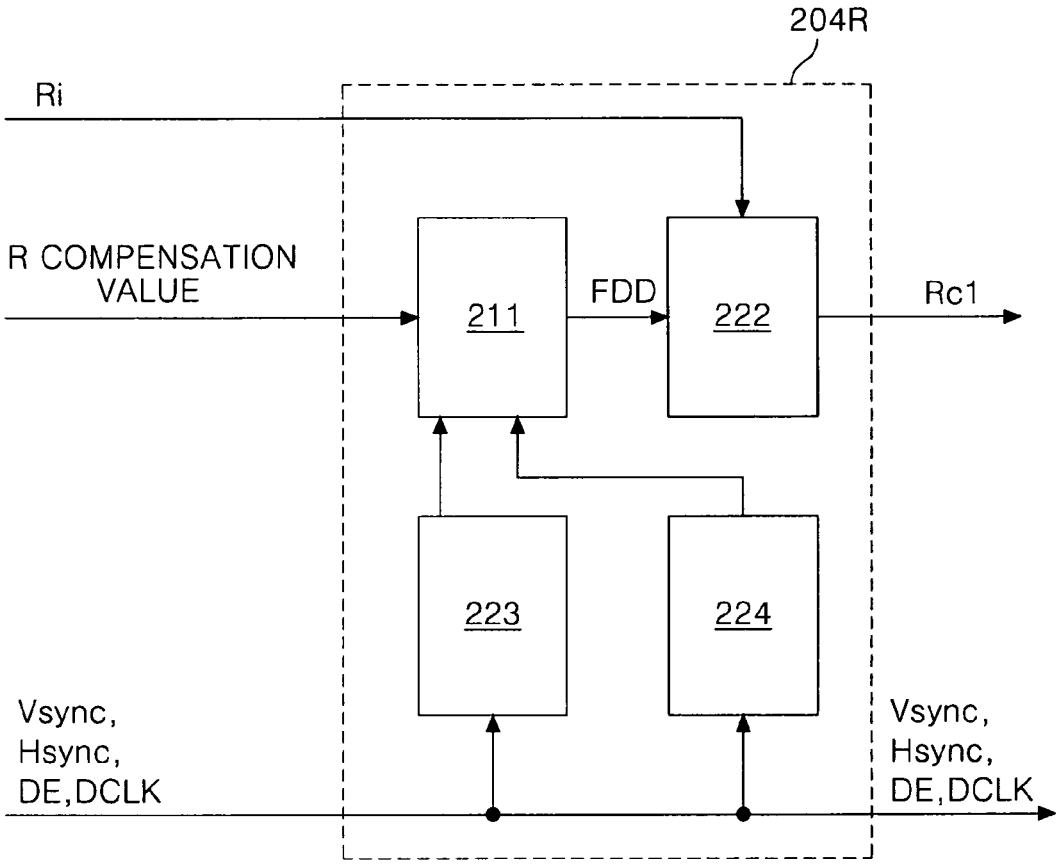
FIG. 23 is a block diagram showing, in detail, a first exemplary FRC and dithering controller of FIG. 22.

FIG. 23 represents a first FRC and dithering controller 204R to correct red data. Second and third FRC and dithering controllers 204G and 204B substantially have the same circuit configuration as the first FRC and dithering controller 204R. As shown in FIG. 23, the first FRC and dithering controller 204R includes a compensation value judging portion 211, a frame number sensing portion 223, a pixel location sensing portion 224, and a calculator 222. The compensation value judging portion 221 judges the R compensation value and generates an FRC and dithering data FDD by taking the compensation value as the value which is to be dispersed to the pixels included in the unit pixel window for the frame periods. The compensation value judging portion 221 is programmed to automatically output the FRC and dithering data according to the R compensation value.

Figure 11:
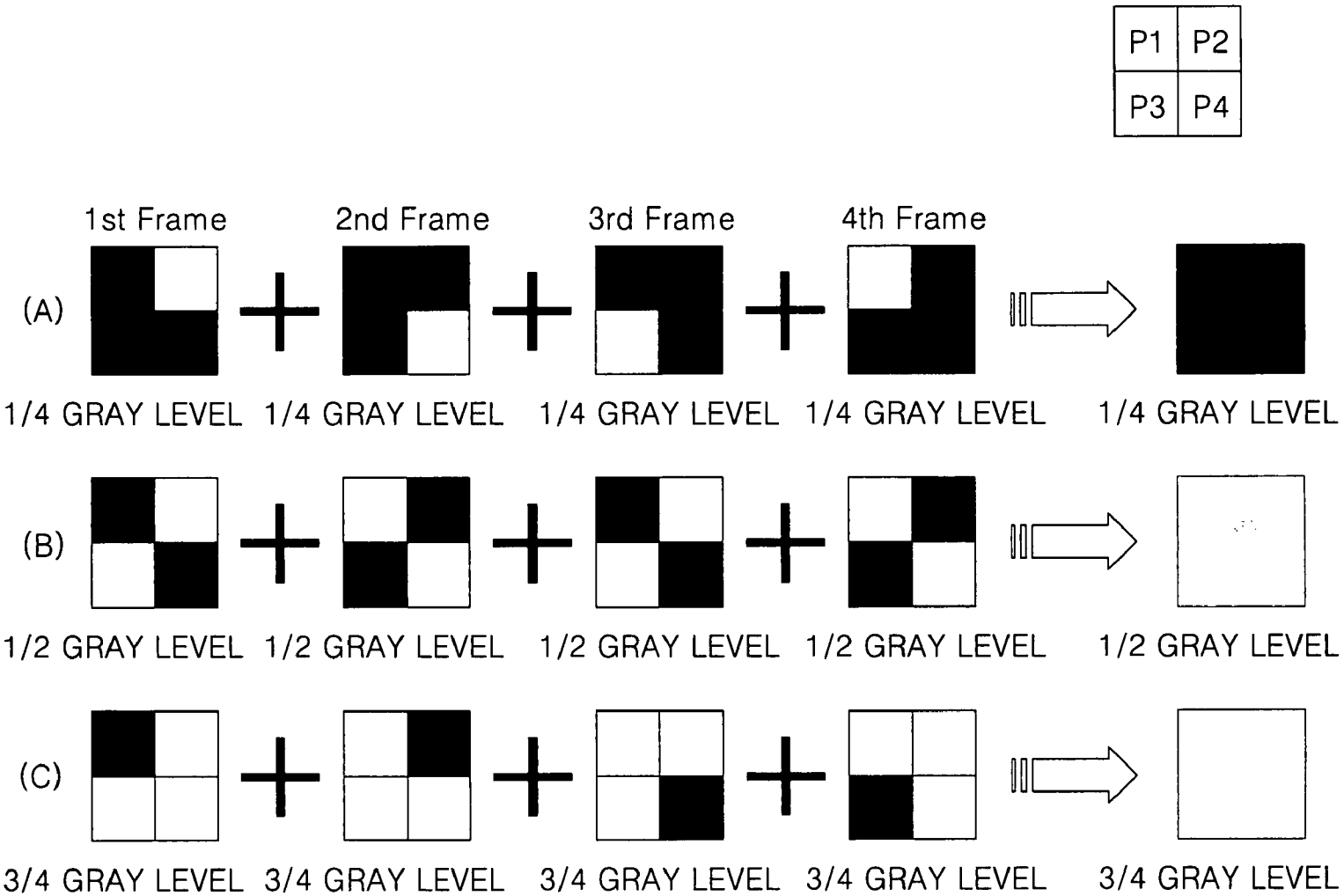
FIG. 11 is an exemplary diagram showing an example of frame rate control and dithering.

For example, the compensation value judging part 221 is pre-programmed to recognize the compensation value for the '0' gray scale level if the R compensation data is '00'. Further, the compensation value judging part 221 is pre-programmed to recognize the compensation value for the '¼' gray scale level if the R compensation data is '01'. Also, the compensation value judging part 221 is pre-programmed to recognize the compensation value for the '½' gray scale level if the R compensation data is '10'. Finally, the compensation value judging part 221 is pre-programmed to recognize the compensation value for the '¾' gray scale level if the R compensation data is '11'. Assuming that the R panel defect compensation data is '01', the four frame periods form one FRC frame group. Also, the four pixels compose one unit pixel window of dithering. The compensation value judging part 221 generates '1' as the FRC and dithering data FDD in one pixel location within the unit location for four frame periods and '0' as the FRC and dithering data FDD in the rest three pixel locations, but changes the location of the pixel where '1' is generated every frame, as shown in FIG. 11.

The frame number sensing portion 223 senses the number of frames using one or more than one of the vertical and horizontal synchronization signal Vsync and Hsync, the dot clock DCLK, and the data enable signal DE. For example, the frame number sensing portion 223 can sense the number of frames by counting the vertical synchronization signal Vsync. The pixel location sensing portion 224 senses the pixel location using one or more than one of the vertical and horizontal synchronization signal Vsync and Hsync, the dot clock DCLK, and the data enable signal DE. For example, the pixel location sensing portion 224 counts the horizontal synchronization signal Hsync and the dot clock DCLK. Thus, it is possible to sense the pixel location. The calculator 222 increases and decreases the input digital video data Ri/Gi/Bi by the FRC and dithering data FDD to generate the corrected digital video data Rc.

The first compensation circuit 51 and the EEPROM 53 according to the sixth exemplary embodiment of the present invention can adjust the data, which is to be displayed at the panel defect location, with the compensation value which is subdivided into 1021 gray scale levels for each color of of R, G and B, while there is almost no flicker and resolution deterioration. Here, it is assumed that the unit pixel window is composed of four pixels and the four frame periods form one FRC frame group.

The second compensation circuit 50 according to the exemplary embodiments of the present invention generates the second correction digital video data Rc2/Gc2/Bc2 by modulating the first correction digital video data Rc1/Gc1/Bc1 using the second compensation data. The second compensation circuit 50 has the circuit configuration substantially similar to that of the first compensation circuit 51, except that the second compensation circuit 50 receives the first correction digital video data Rc1/Gc1/Bc1 and outputs the second correction digital video data Rc2/Gc2/Bc2. On the other hand, the first compensation circuit 51 receives the input digital video data Ri/Gi/Bi and outputs the first correction digital video data Rc1/Gc1/Bc1, thus a detailed explanation for the second compensation circuit 50 will be omitted.

In the foregoing embodiment, the first and second compensation data are calculated by sequentially performing the above described steps. Patterns of a plurality of fixed-formed compensation data corresponding to the various patterns of boundary noise and panel defects are determined through repeated experiments in the actual mass production process. A simple inspection step allows obtaining the optimal compensation data by selecting the optimal compensation data patterns that corresponds to the types of the boundary noise and the panel defect from the data base of the plurality of fixed-formed compensation data. Accordingly, the exemplary method for controlling the picture quality of the present invention can simplify the exemplary compensation method. For example, the first and second compensation circuits can be formed into one compensation circuit that compensates the boundary noise and the panel defect area by using the final compensation data calculated.

The exemplary flat panel display device and the method for controlling the picture quality thereof according to the exemplary embodiments of the present invention has an advantage that the panel defect can be compensated with the electrical compensation regardless of the size or shape of the panel defect formed during the fabrication process. In addition, the color and brightness of the panel defect can be also compensated. Thus, picture quality of any sized or any shaped display panel can be improved by compensating the boundary of the panel defect area and the non-defect area and by compensating the panel defect.

It will be apparent to those skilled in the art that various modifications and variations can be made in the flat display panel, picture quality controlling apparatus and method thereof of the present invention without departing from the spirit or scope of the invention. Thus, it is intended that the present invention cover the modifications and variations of this invention provided they come within the scope of the appended claims and their equivalents.

What is claimed is:

1. A method of controlling a picture quality of a flat panel display device, comprising the step of:

storing a first compensation data used to compensate a panel defect area of a display panel, wherein the first compensation data is judged by a first inspection process, storing a second compensation data used to compensate a boundary between the panel defect area and a non-defect area of the display panel, wherein the second compensation data is judged by a second inspection process;

a first compensation step to modulate data using the first compensation data stored in a memory, wherein first modulated data are supplied to the panel defect area;

a second compensation step to modulate data using the second compensation data stored in the memory, wherein second modulated data are supplied to the boundary of the panel defect area and the non-defect area; and displaying the second modulated data on the display panel, wherein the second modulated data, to be supplied to the panel defect area included in the boundary, is to further modulating the first modulated data us the second compensation data.

2. The method according to claim 1, wherein at least any one of the first and second compensation data includes:

location data indicating the location of the boundary and the panel defect area; and compensation data for each gray scale level of the data which are to be displayed, such that the compensation data for each gray scale level is different.

3. The method according to claim 1, wherein at least any one of the first and second compensation data includes:

an R compensation data to compensate red data;

a G compensation data to compensate green data; and a B compensation data to compensate blue data, wherein the R compensation data, the G compensation data and the B compensation data are set to be the same value for the same gray scale level of the same pixel location.

4. The method according to claim 1, wherein at least any one of the first and second compensation data includes:

an R compensation data to compensate red data;

a G compensation data to compensate green data; and a B compensation data to compensate blue data, wherein a compensation value of at least one of the R compensation data, the G compensation data and the B compensation data is different from the other two compensation data for the same gray scale level of the same pixel location.

5. The method according to claim 1, wherein the first compensation step includes the step of:

increasing or decreasing the data using the first compensation data, wherein the data are to be displayed in the panel defect area.

6. The method according to claim 1, wherein the first compensation step includes the steps of:

extracting n-bits color difference information and n-bits brightness information from the m-bits red color data, m-bits green color data and m-bits blue color data which are to be displayed at the panel defect location, wherein n is an integer larger than m;

generating n-bits modulated brightness information by increasing or decreasing the n-bits brightness information with the first compensation data; and generating m-bits modulated red color data, m-bits modulated green color data and m-bits modulated blue color data by using the n-bits modulated brightness information and un-modulated color difference information, wherein n and m are positive integers and n is larger than m.

7. The method according to claim 1, wherein the first compensation step includes the steps of:

dispersing the first compensation data by frame rate control; and increasing or decreasing the data using the first compensation data which are dispersed, wherein the data are to be displayed at the panel defect area.

8. The method according to claim 7, wherein the first compensation data are dispersed by a unit of frame period.

9. The method according to claim 1, wherein the first compensation step includes the steps of:

dispersing the first compensation data by dithering; and increasing or decreasing the data using the first compensation data which are dispersed, wherein the data are to be displayed at the panel defect area.

10. The method according to claim 9, wherein the first compensation data are dispersed to adjacent pixels of the panel defect area.

11. The method according to claim 1, wherein the first compensation step includes the steps of:

dispersing the first compensation data by frame rate control and dithering; and increasing or decreasing the data using the first compensation data which are dispersed, wherein the data are to be displayed at the panel defect area.

12. The method according to claim 11, wherein the first compensation data are dispersed to adjacent pixels as well as to a plurality of frame periods of the panel defect area.

13. The method according to claim 1, wherein the second compensation step includes the step of:

increasing or decreasing the data, which are to be displayed at the boundary by using the second compensation data.

14. The method according to claim 1, wherein the second compensation step includes the steps of:

extracting n-bits color difference information and n-bits brightness information from m-bits red color data, m-bits green color data and m-bits blue color data which are to be displayed at the boundary;

generating n-bits modulated brightness information by increasing or decreasing the n-bits brightness information with the second compensation data; and generating m-bits modulated red color data, m-bits modulated green color data and m-bits modulated blue color data by using the n-bits modulated brightness information and un-modulated color difference information, wherein n and m are positive integers and n is larger than m.

15. The method according to claim 1, wherein the second compensation step includes the steps of:

dispersing the second compensation data by frame rate control; and increasing or decreasing the data using the second compensation data which are dispersed, wherein the data are to be displayed at the boundary.

16. The method according to claim 15, wherein the second compensation data are dispersed by a unit of frame period.

17. The method according to claim 1, wherein the second compensation step includes the steps of:

dispersing the second compensation data by dithering; and increasing or decreasing the data using the second compensation data which are dispersed wherein the data are to be displayed at the boundary.

18. The method according to claim 17, wherein the second compensation data are dispersed to adjacent pixels of the panel defect area.

19. The method according to claim 1, wherein the second compensation step includes the steps of:

dispersing the second compensation data by frame rate control and dithering; and increasing or decreasing the data using the second compensation data which are dispersed, wherein the data are to be displayed at the boundary.

20. The method according to claim 19, wherein the second compensation data are dispersed to adjacent pixels as well as to a plurality of frame periods of the panel defect area.

21. The method according to claim 1, wherein the boundary is defined at more than one of the panel defect area and the non-defect area, wherein the panel defect area and the non-defect area are adjacent to each other.

22. The method according to any one of claim 1, wherein the boundary includes a plurality of pixel windows each having i×j number of pixels, wherein the second compensation data are set to be a compensation value to reduce a brightness difference in k number of pixels within the pixel window at a location where the brightness difference is higher, and the second compensation data are set to be the compensation value to reduce the brightness difference in h number of pixels within the pixel window at a location where the brightness difference is relatively lower, wherein i, j, k and h are positive integers and h is smaller than k.

23. A flat panel display device, comprising:

a display panel to display an image;

a memory that stores a first compensation data to compensate a panel defect area of a display panel, wherein the first compensation data is judged by a first inspection process, a second compensation data to compensate a boundary between the panel defect area and a non-defect area of the display panel, wherein the second compensation data is judged by a second inspection process;

a first compensation part to modulate data using the first compensation data stored in the memory, wherein the modulated data are supplied to the panel defect area;

a second compensation part to modulate the first modulated data using the second compensation data stored in the memory, wherein second modulated data are supplied to the panel defect area and the non-defect area, and to supply un-modulated data to the non-defect area; and a driver to display the data modulated by the second compensation part on the display panel, wherein the second modulated data, to be supplied to the panel defect area included in the boundary, is to further modulating the first modulated data using the second compensation data.

24. The flat panel display device according to claim 23, wherein at least any one of the first and second compensation data includes:

location data indicating the location of the boundary and the panel defect area; and compensation data for each gray scale level of the data which are to be displayed, such that the compensation data for each gray scale level is different.

25. The flat panel display device according to claim 23, wherein at least any one of the first and second compensation data includes:

an R compensation data to compensate red data;

a G compensation data to compensate green data; and a B compensation data to compensate blue data, wherein the R compensation data, the G compensation data and the B compensation data are set to be the same value for the same gray scale level of the same pixel location.

26. The flat panel display device according to claim 23, wherein at least any one of the first and second compensation data includes:

an R compensation data to compensate red data;

a G compensation data to compensate green data; and a B compensation data to compensate blue data, wherein a compensation value of at least one of the R compensation data, the G compensation data and the B compensation data is different from the other two compensation data for the same gray scale level of the same pixel location.

27. The flat panel display device according to claim 23, wherein the first compensation part increases or decreases the data with the first compensation data, the data are to be displayed in the panel defect area.

28. The flat panel display device according to claim 23, wherein the first compensation parts extracts n-bits color difference information and n-bits brightness information from m-bits red color data, m-bits green color data and m-bits blue color data that are to be displayed at the panel defect location;

generates n-bits modulated brightness information by increasing or decreasing the n-bits brightness information with the first compensation data; and generates m-bits modulated red color data, m-bits modulated green color data, and m-bits modulated blue color data by using the n-bits modulated brightness information un-modulated color difference information, wherein n and m are positive integers and n is larger than m.

29. The flat panel display device according to claim 23, wherein the first compensation part disperses the first compensation data by frame rate control, and increases or decreases the data with the first compensation data which are dispersed by frame rate control, wherein the data are to be displayed at the panel defect area.

30. The flat panel display device according to claim 29, wherein the first compensation data are dispersed by a unit of frame period.

31. The flat panel display device according to claim 23, wherein the first compensation part disperses the first compensation data by dithering, and increases or decreases the data with the first compensation data which are dispersed by dithering, wherein the data are to be displayed at the panel defect area.

32. The flat panel display device according to claim 31, wherein the first compensation data are dispersed to adjacent pixels of the panel defect area.

33. The flat panel display device according to claim 23, wherein the first compensation part disperses the first compensation data by frame rate control and dithering, and increases or decreases the data with the first compensation data which are dispersed in temporal manner and spatially, wherein the data are to be displayed at the panel defect area.

34. The flat panel display device according to claim 33, wherein the first compensation data are dispersed to adjacent pixels as well as to a plurality of frame periods of the panel defect area.

35. The flat panel display device according to claim 23, wherein the second compensation part increases or decreases the data with the second compensation data, wherein the data to be displayed at the boundary.

36. The flat panel display device according to claim 23, wherein the second compensation part extracts n-bits color difference information and n-bits brightness information from m-bits red color data, m-bits green color data and m-bits blue color data that are to be displayed at the boundary;

generates n-bits modulated brightness information by increasing or decreasing the n-bits brightness information with the second compensation data; and generates m-bits modulated red color data, m-bits modulated green color data and m-bits modulated blue color data by using the n-bits modulated brightness information un-modulated color difference information, where n and m are positive integers and n is larger than m.

37. The flat panel display device according to claim 23, wherein the second compensation part disperses the second compensation data by frame rate control, and increases or decreases the data with the second compensation data which are dispersed, wherein the data are to be displayed at the boundary.

38. The flat panel display device according to claim 37, wherein the second compensation data are dispersed by a unit of frame period.

39. The flat panel display device according to claim 23, wherein the second compensation part disperses the second compensation data by dithering, and increases or decreases the data with the second compensation data which are dispersed, wherein the data are to be displayed at the boundary.

40. The flat panel display device according to claim 39, wherein the second compensation data are dispersed to adjacent pixels of the panel defect area.

41. The flat panel display device according to claim 23, wherein the second compensation part disperses the second compensation data by frame rate control and dithering, and increases or decreases the data with the second compensation data which are dispersed, wherein the data are to be displayed at the boundary.

42. The flat panel display device according to claim 41, wherein the second compensation data are dispersed to adjacent pixels as well as to a plurality of frame periods of the panel defect area.

43. The flat panel display device according to claim 23, wherein the boundary is defined at more than one of the panel defect area and the non-defect area, wherein the panel defect area and the non-defect area are adjacent to each other.

44. The flat panel display device according to claim 23, wherein the boundary includes a plurality of pixel windows having i×j number of pixels, respectively;

wherein the second compensation data are set to be a compensation value to reduce a brightness difference in k number of pixels within the pixel window at a location where the brightness difference is higher, and the second compensation data are set to be the compensation value to reduce the brightness difference in h number of pixels within the pixel window at a location where the brightness difference is relatively lower, such that i, j, k and h are positive integers and h is smaller than k.

45. The flat panel display device according to claim 23, wherein the display panel includes:

a liquid crystal display panel where a plurality of data lines cross a plurality of gate lines to form a plurality of liquid crystal cells in matrix.

46. The flat panel display device according to claim 45, wherein the driver includes:

a data driver to convert a video data into analog voltages which can express gray scale levels and to supply the analog voltages to the data lines;

a gate driver to supply a scan pulse to the gate lines sequentially; and a timing controller to control the data driver and the gate driver and to supply the data modulated by the second compensation part to the data driver, wherein the memory and the first and second compensation parts are embedded in the timing controller.

* * * * *